US007434358B2

(12) United States Patent
Smith

(10) Patent No.: US 7,434,358 B2
(45) Date of Patent: Oct. 14, 2008

(54) PANEL ASSEMBLY FOR UNDERDECK DRAINAGE AND OTHER APPLICATIONS

(75) Inventor: Jeffrey E. Smith, Alpharetta, GA (US)

(73) Assignee: Amerimax Diversified Products, Inc., Duluth, GA (US)

( * ) Notice: Subject to any disclaimer, the term of this patent is extended or adjusted under 35 U.S.C. 154(b) by 438 days.

(21) Appl. No.: 11/162,054

(22) Filed: Aug. 26, 2005

(65) Prior Publication Data

US 2006/0162262 A1 Jul. 27, 2006

Related U.S. Application Data

(60) Provisional application No. 60/643,232, filed on Jan. 11, 2005, provisional application No. 60/595,558, filed on Jul. 14, 2005.

(51) Int. Cl.

| | |
|---|---|
| ***E04D 13/00*** | (2006.01) |
| ***E04D 13/08*** | (2006.01) |
| ***E04B 1/70*** | (2006.01) |
| ***E04F 17/00*** | (2006.01) |

(52) U.S. Cl. ..... 52/14; 52/11; 52/15; 52/16; 52/302.1; 52/302.3; 52/302.6

(58) Field of Classification Search ..... 52/11, 52/14–16, 93.1, 302.1, 302.3, 302.6, 506.06, 52/533, 592.1

See application file for complete search history.

(56) References Cited

U.S. PATENT DOCUMENTS

| | | | | |
|---|---|---|---|---|
| 1,350,027 | A | 8/1920 | Lane et al. | |
| 3,199,258 | A | 8/1965 | Jentoft et al. | |
| 3,220,469 | A | 11/1965 | Oehmig | |
| 4,009,541 | A * | 3/1977 | Yoneya | 52/14 |
| 4,065,883 | A | 1/1978 | Thibodeau | |
| 4,084,360 | A | 4/1978 | Reckson | |
| 4,233,790 | A | 11/1980 | Meadows | |
| 4,261,144 | A | 4/1981 | Rizzo | |
| 4,410,027 | A | 10/1983 | Lucous | |
| 4,662,038 | A | 5/1987 | Walker | |
| 4,663,894 | A | 5/1987 | LaRoche et al. | |
| 4,665,670 | A | 5/1987 | van den Burg | |
| 4,690,192 | A | 9/1987 | Stilling | |

(Continued)

FOREIGN PATENT DOCUMENTS

WO WO 01/38668 A1 * 5/2001

*Primary Examiner*—Richard E. Chilcot, Jr.
*Assistant Examiner*—Branon C Painter
(74) *Attorney, Agent, or Firm*—Morris, Manning & Martin

(57) ABSTRACT

A panel assembly for providing underdeck water drainage and for other applications such as wall panels and skirting for exposed areas under building. The panel assembly, for an underdeck water drainage system, includes a plurality of joist brackets that are mounted transversely to and under the joists of a deck, a plurality of drainage panels, a plurality of drainage panel brackets, and a plurality of joist bracket spacers. The drainage panels may be slidingly engaged or snapped into separate panel brackets or into panel bracket portions of adjacent drainage panels. When properly installed, the underdeck drainage system will protect an area of interest, such as a patio or storage area under a deck, from rain water and keep the area dry. Another application of the present invention is to provide a shield, skirt, or cover for an exposed area under a deck, a home, a mobile home, a wall, or other place of interest.

205 Claims, 27 Drawing Sheets

U.S. PATENT DOCUMENTS

| | | | | |
|---|---|---|---|---|
| 4,731,960 | A | 3/1988 | Sease | |
| 4,787,773 | A | 11/1988 | Kehler | |
| 4,899,797 | A | 2/1990 | Green | |
| 5,195,281 | A | 3/1993 | Kosko | |
| 5,511,351 | A | 4/1996 | Moore | |
| 5,758,467 | A | 6/1998 | Snear et al. | |
| 5,765,328 | A | 6/1998 | Moore | |
| 6,129,838 | A | 10/2000 | Millner | |
| 6,164,019 | A | 12/2000 | Salley | |
| 6,199,340 | B1 | 3/2001 | Davis | |
| 6,212,887 | B1 | 4/2001 | Takada | |
| 6,226,941 | B1 | 5/2001 | Stevens | |
| 6,226,956 | B1 | 5/2001 | Davis et al. | |
| 6,260,316 | B1 * | 7/2001 | Davis et al. | 52/302.3 |
| 6,308,479 | B1 | 10/2001 | Prohofsky | |
| 6,343,450 | B1 * | 2/2002 | Vance, Jr. | 52/302.1 |
| 6,385,931 | B1 | 5/2002 | Risser | |
| 6,389,771 | B1 * | 5/2002 | Moller | 52/506.06 |
| 6,393,785 | B1 | 5/2002 | Burt | |
| 6,415,571 | B2 | 7/2002 | Risser | |
| D466,596 | S | 12/2002 | Stegmeier, Sr. et al. | |
| 7,010,894 | B1 * | 3/2006 | Cappelle | 52/480 |
| 2002/0035811 | A1 * | 3/2002 | Heuel | 52/506.05 |
| 2003/0009973 | A1 * | 1/2003 | Lee | 52/589.1 |

* cited by examiner

PANEL ASSEMBLY FOR UNDERDECK DRAINAGE AND OTHER APPLICATIONS

CROSS-REFERENCE TO RELATED PATENT APPLICATIONS

This application claims priority to and the benefit of, pursuant to 35 U.S.C. §119(e), U.S. provisional patent application No. 60/643,232, filed Jan. 11, 2005, entitled "Underdeck Drainage II," by Jeffrey E. Smith, and U.S. provisional patent application No. 60/595,558, filed Jul. 14, 2005, entitled "Underdeck Drainage System," by Jeffrey E. Smith, which are incorporated herein by reference in their entirety.

FIELD OF THE INVENTION

The present invention generally relates to water drainage for decks on residential houses and other buildings, and more particularly, to a panel assembly for use in providing an underdeck water drainage system and for other applications such as wall panels, ceiling panels, and decorative exterior panels such as trailer and mobile home skirts and the like.

BACKGROUND OF THE INVENTION

Decks made of parallel planking are often constructed at residential houses and other buildings to provide an outdoor living or gathering area. Sometimes these decks are elevated on pilings or supports so that the deck can be accessed from an above-ground level. In such cases of an elevated deck, a space is necessarily provided below the deck. This space may or may not be usable for other purposes, but often receives water that drains through spaces in the deck planking during rain events or cleaning.

A conventional deck construction provides openings between adjacent deck boards or planks forming the deck surface so that water will fall through the openings and not accumulate on the deck surface. However, the area under the deck, which may be used as a second patio or storage area, is exposed to the elements of nature, particularly rain that passes through the openings in the deck. This severely limits the use of the space under the deck. It may be desirable to otherwise collect or divert this water to thereby make the underdeck area dry and usable for other purposes such as storage or recreation.

Various types of water drainage systems for decks are known in the art. Many of these known systems have proven at least partially effective for creating dry and usable spaces below decks. But many of the known systems have certain drawbacks and leave room for improvement. For example, the known DRY•B•LO system (http://www.dri-b-lo.com), which is believed shown in U.S. Pat. Nos. 5,511,351 and 5,765,328, provides a plurality of flexible panels made of a web material mounted side-by-side in succession in overlapping relationship, straddling adjacent deckjoists. Installation of this system requires extensive manual labor, with many multiple fasteners, and is thus expensive and time-consuming to install. Although the structure is advertised as readily disgorging debris because of its flexible nature, its permanent mounting nature makes it difficult to readily remove, clean, and replace with the same panels.

The known system provided by the Underdeck Company, Plymouth, Minn. requires four separate components—a joist rail, collector panels, joist gutters, and boundary gutters. It is believed that this company's products are described in U.S. Pat. Nos. 6,308,479, 6,226,956 and 6,212,887. One issue with this system is the diversion of water towards the joist gutters.

Heavy accumulation of water from rainfall is directed toward the joists, which have joist gutters to carry away the water. If the water flow is heavy, it can seep over the edges of the joist gutter mounting structure and contact with the wood of the joist. Over time, this may result in damage to the bottom edges of the joists. Furthermore, this design results in visible joist gutters and does not permit a flat, flush appearance of ceiling and water drainage system. Further still, special collector panels are required for this system if a deck has inconsistent joist spacing, the joist rails are difficult to install at the edges, the panels easily dent and crease, and deck railing post fasteners and support braces can interfere with installation.

The known DRYSPACE system, as shown in U.S. Pat. No. 6,393,785, involves use of joist covers and separate F-brackets that must be mounted to the bottom of a deck joist, with the F-brackets supporting V-shaped panels. The material of the F-brackets is relatively thin and weak, and may not support a significant water load on the panels. Furthermore, it is possible that during heavy rainfall, water can seep inwardly of the panels into the F-brackets and over the top edge of the F-brackets into the joist covers where it can contact the wood of the joists. This can result in damage to the joists over time.

U.S. Pat. No. 6,226,941 describes an undercover system mounted below and separate from the deck frame that serves to keep water and debris passing through the deck structure off of the prescribed area. While different mounting arrangements are contemplated, the undercover system in this patent is typically mounted between the wall of a building and posts holding the deck frame. Because the undercover system is separate from the deck frame, the drainage surface must be fairly rigid and self-supporting to carry the water as well as the weight of the panels that drain the water. Furthermore, this system requires a 4 inch to 7 inch space between the bottom of the deck and the panels, which can diminish the amount of overhead room in certain applications.

Some deck drainage systems require installation before the decking planks are installed. The Rainescape system (http://www.rainescape.com) is one such system. Such systems are clearly inconvenient for preconstructed decks, as the decking must be removed in order to install the drainage system.

The system shown in U.S. Pat. Nos. 6,415,571 and 6,385,931 provides a plurality of trapezoid-shaped panels that are fastened to joist ends. Significant sealing and caulking may be required along the extensive seams in this approach to prevent leakage, which is time-consuming and difficult to create a smooth appearance.

Other approaches to underdeck water drainage are shown in U.S. Pat. Nos. 4,065,883; 5,195,281; 6,308,479; 6,164,019; and D466,596.

With many of these known underdeck drainage systems, over a period of time, the drainage panel may be degraded and/or damaged, and there may be leaves and/or other debris accumulated on the drainage panel surface so that the panel surfaces become clogged. However, it is difficult or a least inconvenient to remove, clean, and/or replace components in many of these known drainage systems.

There is thus a need for an underdeck drainage system that is easy to install, easy to remove, and therefore easy to maintain and/or clean. There is a need for a system that can be used for new deck construction as well as aftermarket installation on preconstructed decks. There is a need for a system that can readily accommodate inconsistent joist spacing and the presence of railing post fasteners and support braces, and does not require separate special panels. There is also a need for a system that minimizes water contact with joists and other wood components of a deck to prolong the life of the joists and other components. The present invention addresses many of these unfulfilled needs.

SUMMARY OF THE INVENTION

The above-mentioned disadvantages of the prior art are overcome by the present invention, which, in one aspect, relates to an underdeck water drainage system for mounting beneath a deck assembly, where the deck assembly has spaced floor boards extending over a predetermined surface area, the spaced floor boards are supported by a plurality of parallel, regularly-spaced joists. According to an aspect of the invention, the drainage system is for mounting beneath a deck assembly, the deck assembly having spaced floor boards extending over a predetermined surface area, the spaced floor boards being supported by a plurality of usually parallel spaced-apart joists. The underdeck drainage system includes a plurality of joist brackets, mountable to and across (perpendicular to) the plurality of joists, a plurality of drainage panels, a plurality of panel brackets connecting the plurality of drainage panels, and a plurality of stackable joist bracket spacers mountable to the plurality of joist brackets for providing slope or pitch to the drainage panels. The drainage panels direct water to gutters mounted at an end of the assembly, typically along an edge of the deck.

In one aspect, each of the plurality of joist brackets has a bottom portion, an opposite top portion, at least one notched receptacle extending widthwise on the bottom portion at a predetermined position, a pair of notched grooves lengthwise formed on the top portion, and a plurality of obround openings regularly formed on the top portion. The notched receptacle is for receiving and supporting the panel brackets. The notched grooves are for receiving stackable joist bracket spacers.

According to one aspect of the joist brackets, each of the plurality of joist brackets further comprises a first end, an opposite second end, at least one dovetailed peg formed on the first end, and at least one dovetailed notch formed on the second end such that when two joist brackets are joined, the at least one dovetailed peg of the first joist bracket is received in and engaged with the at least one dovetailed notch of the second joist bracket, for connecting multiple joist brackets together to extend the length.

According to another aspect of the joist brackets, each of the plurality of joist brackets further comprises a first end, an opposite second end, at least one tenon formed on the first end, and at least one mortise formed on the second end such that when two joist brackets are joined, the at least one tenon of the first joist bracket is received in and engaged with the at least one mortise of the second joist bracket.

According to one aspect of an embodiment of the drainage panels, each of the drainage panels has a first edge and an opposite second edge, and a first flange and an opposite second flange extending outward and widthwise from the first edge and the second edge, respectively. In another embodiment, each of the plurality of drainage panels includes a first surface, an opposite second surface, and a plurality of ridges lengthwise protruding from the first surface to form a plurality of drainage channels thereon, a first flange and a second flange with a number of protrusions lengthwise formed on flange surfaces.

In one embodiment, each of the plurality of panel brackets has a first surface, an opposite second surface, a U-shaped peg lengthwise protruding from the first surface, a first U-shaped notched receptacle and an opposite second U-shaped notched receptacle defined between the first surface and the second surface, the notched receptacles for receiving and supporting drainage panels. The U-shaped peg is for affixing into, slidably and/or by snap-in, the receptacle in the joist brackets.

In another embodiment, each of the U-shaped receptacles of the plurality of the panel brackets has a number of grooves lengthwise formed therein such that, in operation, the number of protrusions on the flange surfaces of the drainage panel are received in and engaged with a corresponding number of grooves of the panel brackets, respectively.

In one aspect of the joist bracket spacers, each of the plurality of joist bracket spacers has a frame, an obround ring forming an obround opening, and a plurality of ribs connecting and supporting the ring and the frame. In another aspect, each of the plurality of joist bracket spacers further has a first end portion, an opposite second end portion, a first pair of openings and a first pair of pegs formed on the first end portion, and a second pair of openings and a second pair of pegs formed on the second end portion, where the first pair of pegs and the second pair of pegs are respectively offset from the first pair of openings and the second pair of openings such that when two identical joist bracket spacers are joined, the first pair of pegs and the second pair of pegs of one of two joist bracket spacers are received in and engaged with the first pair of openings and the second pair of openings of the other joist bracket spacer, respectively.

In a further aspect of the joist bracket spacers, each of the plurality of joist bracket spacers further includes a first surface, an opposite, second surface, a opening formed through the first surface and the second surface at a predetermined position, a pair of notched grooves formed on the first surface, and a pair of notched pegs formed on the second surface at corresponding positions of the pair of notched grooves such that when two identical joist bracket spacers are joined, a pair of notched pegs of one of two joist bracket spacers are received in and engaged with a pair of notched grooves of the other joist bracket spacer, respectively.

When an underdeck drainage system according to aspects of the invention is in operation, the first flange and the second flange of each of the plurality of drainage panels are received in the U-shaped notched receptacle of one of the plurality of panel brackets and the second U-shaped notched receptacle of another panel bracket, respectively. The U-shaped pegs of the plurality of panel brackets are received in corresponding notched receptacles of the plurality of joist brackets, respectively. The plurality of drainage panels are engaged with the plurality of panel brackets, which, in turn, are engaged with the plurality of joist brackets.

In one embodiment, when the joist bracket spacers are in operation, the first pair of pegs and the second pair of pegs of one of the plurality of joist bracket spacers are received in and engaged with the pair of notched grooves of another one of the plurality of joist brackets, respectively. In another embodiment, when these joist bracket spacers are in operation, the pair of notched pegs of one of the plurality of joist bracket spacers are received in and engaged with the pair of notched grooves of one of the plurality of joist bracket such that the second surface of the corresponding joist bracket spacer is substantially in contact with the top portion of the corresponding joist bracket, and the opening of the corresponding joist bracket spacer is substantially coincident or aligned with one of the plurality of obround opening of the corresponding joist bracket.

Advantageously, by mounting the joist brackets across (perpendicular) to a plurality of underdeck joists, it does not matter about the spacing of the joists, whether the spacing is regular or inconsistent. A system constructed in accordance with the invention is not dependent on particular joist spacing and can be readily adapted for many applications.

In one embodiment, the drainage system further comprises a trim channel cover mountable to a discharging end of the plurality of drainage panels to collect water therefrom and direct it to a downspout. In another embodiment, the trim channel cover comprises a gutter.

In another aspect, the present invention relates to a drainage system for mounting beneath a deck assembly, where the deck assembly has spaced floor boards extending over a predetermined surface area, the spaced floor boards are supported by a plurality of generally parallel joists. In one aspect, the underdeck drainage system comprises a plurality of joist brackets mountable to the plurality of joists, where each of the plurality of the joist brackets has a bottom portion, an opposite, top portion, at least one notched receptacle widthwise protruding from the bottom portion at a predetermined position, a pair of notched grooves lengthwise formed on the top portion, and a plurality of obround openings regularly formed through the top portion. In another aspect of the joist brackets, each of the plurality of the joist brackets further comprises a first end, an opposite, second end, at least one dovetailed peg formed on the first end, and at least one dovetailed notch formed on the second end such that when two joist brackets are joined, the at least one dovetailed peg of one of two joist brackets is received in and engaged with the at least one dovetailed notch of the other joist bracket. In yet another embodiment, the plurality of joist brackets further comprise a first end, an opposite second end, at least one tenon formed on the first end, and at least one mortise formed on the second end such that when two joist brackets are joined, the at least tenon of one of two joist brackets is received in and engaged with the at least one mortise of the other joist bracket.

According to another embodiment of the invention, the underdeck drainage system comprises a plurality of drainage panels having a flange along one edge and a flange receptacle or bracket along another edge. In this embodiment, each of the plurality of the drainage panels has a first edge, an opposite second edge, a flange widthwise extending from the first edge, and a panel bracket or receptacle widthwise extending from the second edge. The panel bracket or receptacle is preferably a U-shaped notched receptacle parallel to the drainage panel and a U-shaped peg protruding perpendicularly and lengthwise from a junction of the second edge and the panel bracket. The U-shaped peg is received, slidably or by snap-in, corresponding receptacle in joist brackets.

In another embodiment of the drainage panels, each of the drainage panels comprises a first surface, an opposite second surface, and a plurality of ridges lengthwise protruding from the first surface to form a plurality of drainage channels thereon. In yet another embodiment, the flange of a drainage panel has a number of protrusions lengthwise formed on flange surfaces, and the U-shaped notched receptacle of the drainage panel has a number of grooves lengthwise formed therein. In a further embodiment, when two drainage panels are connected, the number of protrusions on the flange surfaces of one of two drainage panels are received in and engaged with the number of grooves of the U-shaped notched receptacle of the other drainage panel.

According to another aspect of the invention, the underdeck drainage system comprises a plurality of joist bracket spacers mountable to the plurality of joist brackets for setting up a pitch or slope of the drainage system. In another aspect, each of the plurality of joist bracket spacers comprises a frame, a ring forming an opening, and a plurality of ribs connecting the ring and the frame. In another aspect, the plurality of joist bracket spacers further comprises a first end portion, an opposite, second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

In a further aspect of the joist bracket spacers, the first pair of pegs and the second pair of pegs of one of the plurality of joist bracket spacers are received in and engaged with the pair of notched grooves and of one of the plurality of joist brackets, respectively. In yet another aspect, each of the plurality of joist bracket spacers has a first surface, an opposite second surface, a opening formed through the first surface and the second surface at a predetermined position, a pair of notched grooves formed on the first surface, and a pair of notched pegs and formed on the second surface at corresponding positions of the pair of notched grooves such that when two joist bracket spacers are joined, a pair of notched pegs of one of two joist bracket spacers are received in and engaged with a pair of notched grooves of the other joist bracket spacer, respectively.

In yet a further aspect of the joist bracket spacers, the pair of notched pegs of one of the plurality of joist bracket spacers are received in and engaged with the pair of notched grooves of one of the plurality of joist brackets such that the second surface of the corresponding joist bracket spacer is substantially in contact with the top portion of the corresponding joist bracket, and the opening of the corresponding joist bracket spacer is substantially coincident or aligned with one of the plurality of obround openings of the corresponding joist bracket.

In one embodiment, the underdeck drainage system further includes a trim or end channel cover mounted to one end of the drainage panels (the higher or nondischarging end), and a gutter system at the other end of the drainage panels (the lower or discharging end) to collect the water and direct it to a downspout.

The components of the underdeck drainage system, such as the plurality of joist brackets, the plurality of drainage panels, the plurality of panel brackets, the plurality of joist bracket spacers, and the trim channel cover are made of generally rigid material such as plastic, metal, or the like.

The present invention, as decorative panel system, is not limited to providing a water-draining underdeck system. The panel system can also be used for other purposes, such as for walls, ceilings, and decorative or space-concealing members for mobile home skirting, deck or room sides, porches, and the like. According to another aspect of the invention, therefore, the panel system is used to provide a wall panel system, a ceiling system, or a skirting system for covering an area of interest. According to this aspect, the skirting system comprises a plurality of support brackets mountable in the area of interest and a plurality of panels mountable to the plurality of support brackets. In another embodiment, the skirting system further comprises a plurality of panel brackets adapted for connecting two adjacent panels and engaging the connected panels with the plurality of support brackets.

DETAILED DESCRIPTION OF THE INVENTION

The present invention is more particularly described in the following examples that are intended to be illustrative only since numerous modifications and variations therein will be apparent to those skilled in the art. Various embodiments of the invention are now described in detail. Refer now to the drawings, where like numbers indicate like parts throughout the views. As used in the description herein and throughout the claims that follow, the meaning of "a," "an," and "the" includes the plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings FIGS. 1-15. In accordance with the purposes of this invention, as embodied and broadly described herein, this invention, in one aspect, relates to a water drainage system for a deck assembly. The deck assembly has spaced floor boards extending over a predetermined surface area, where the spaced floor boards are supported by a plurality of parallel, regularly-spaced joists.

Figure 1:
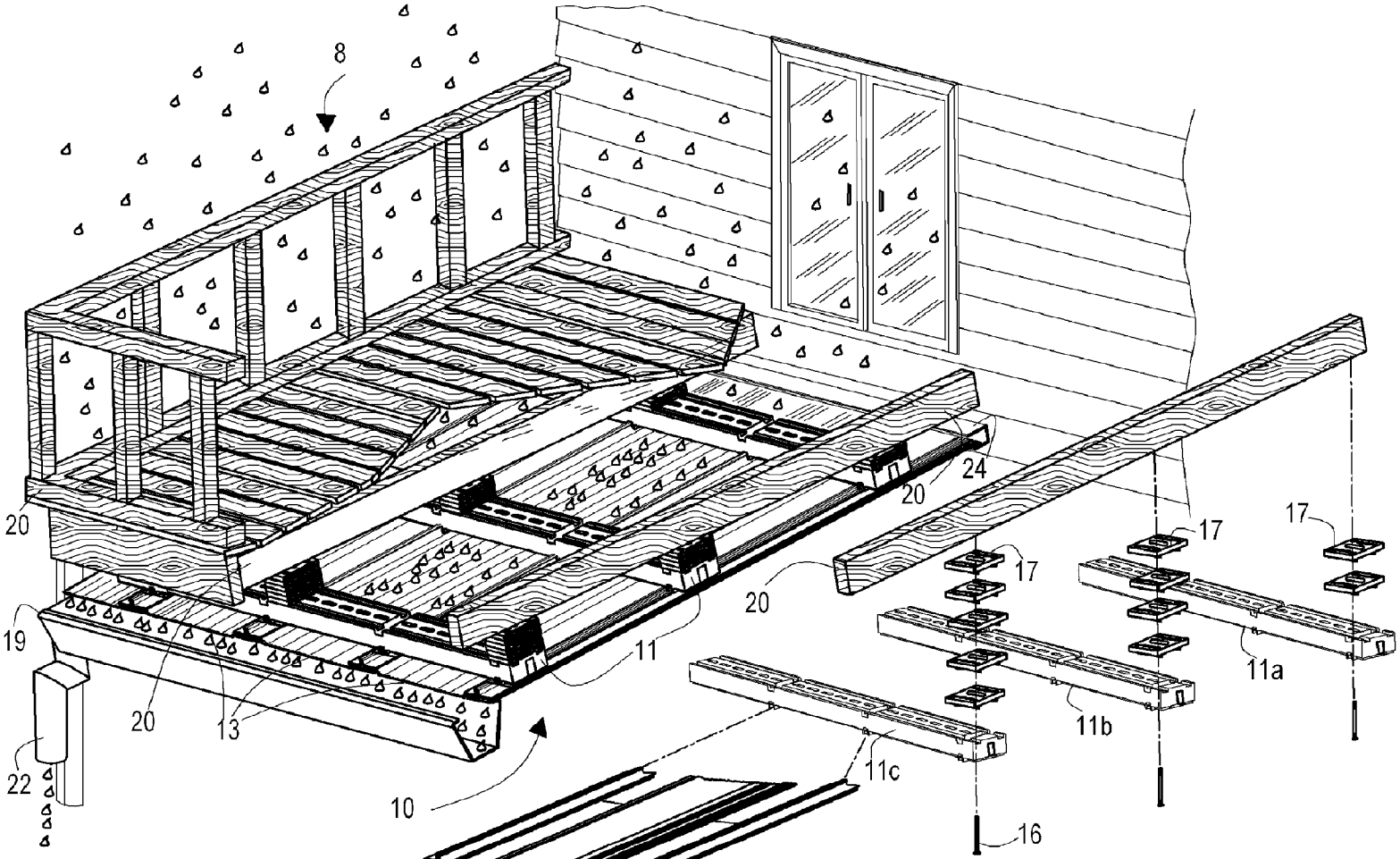
FIG. 1 is a perspective view of an underdeck drainage system installed beneath a deck assembly according to one embodiment of the present invention.

Referring now to FIG. 1, an underdeck drainage system 10 is shown under a deck assembly 8 according to one embodiment of the present invention. The underdeck drainage system 10 has a plurality of joist brackets 11 mountable to the underside of and perpendicularly across of a plurality of deck floor supporting joists 20, a plurality of drainage panels 13 adapted for forming a water shield under a deck assembly, a plurality of panel brackets 15 adapted for connecting the plurality of the drainage panels 13, a plurality of stackable joist bracket spacers 17 adapted for setting a pitch for the underdeck drainage system, and a gutter system 19 for guiding the water collected by the underdeck drainage system to a downspout 22. A U-shaped end or trim channel 24 is also provided, at the highest end of the drainage system opposite the gutter system 19.

When the underdeck drainage system 10 is assembled, the drainage panels 13 are connected and supported by the panel brackets 15. The panel brackets 15 are preferably first attached to the underside of the joist brackets 11 by sliding engagement or by snapping in, and the drainage panels are then slid into the panel brackets. Alternatively, an assembly of panel brackets that have already been engaged by drainage panels can be affixed to the joist brackets 11.

The joist brackets 11 are attached to underside of the joists 20 with or without the joist bracket spacers 17, but preferably with spacers 17 provided in progressively larger stacks to provide a pitch for drainage. The joist bracket spacers 17 provide a pitch for the drainage panels 13 so one end of the drainage panel is higher than the other end where the water will be collected into a gutter system 19. For example, as shown in FIG. 1 for a deck assembly having joist beams 20 installed as shown, two joist bracket spacers 17 are installed in between the joist and the joist bracket 11*a*, four joist bracket spacers 17 are installed in between the joist and the joist bracket 11*b*, and five joist bracket spacers 17 are installed in between the joist and the joist bracket 11*c*. It will of course be understood that the example of two, four, and five joist bracket spacers is merely one illustrative. Other number combinations of joist bracket spacers can also be used to practice this invention. The exact number of joist bracket spacers utilized to obtain a desired pitch will vary. Preferably, therefore, the outer or discharge end of the drainage panels 13 towards the gutter system 19 is lower than the inner end of the drainage panels nearest the house, so that the water will be directed to the lower end of the drainage panels 13 where the gutter system 19 is located.

The joist brackets 11 are fastened to the underside of the joists 20 of the of the deck assembly with either hot dipped galvanized screws/nails or stainless steel screws/nails according to one embodiment of the present invention. Preferably, the joist brackets 11 are fastened transversely across (perpendicularly) to the underside of the joists 20, but could be attached at any angle. The gutter system 19 is installed transversely across the discharging end of the plurality of drainage panels 13 to collect water therefrom and direct it to a downspout 22. A U-shaped channel member 24 is provided to support the edge of the drainage panels adjacent the house, and provide a water barrier.

Figure 2A:
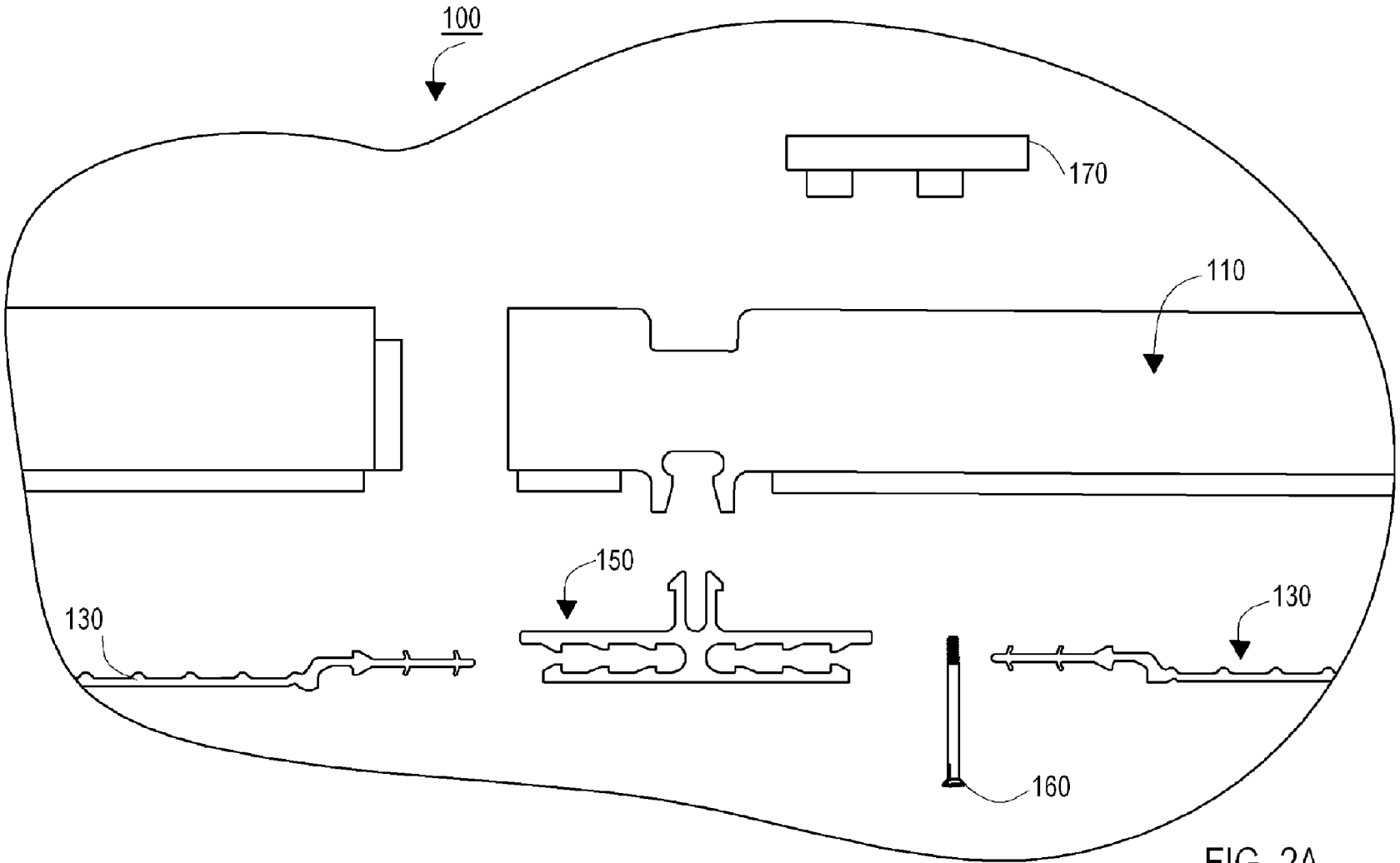
FIG. 2, consisting of FIGS. 2A and 2B, respectively shows (A) an exploded view and (B) an exploded perspective view of an underdeck drainage system according to one embodiment of the present invention.

Referring now to FIG. 2A, a preferred embodiment of an underdeck drainage system 100 is shown. The underdeck drainage system 100 has a plurality of joist brackets 110 adapted for attaching the drainage system to the underside of the deck assembly, a plurality of drainage panels 130 adapted for channeling water flow toward the gutter system, a plurality of panel brackets 150 adapted for connecting the plurality of drainage panels 130 and attaching the connected drainage panels to the joist brackets 110, and a plurality of joist bracket spacers 170 for setting a pitch of the drainage panels 130. A plurality of screws or nails 160 are used to fasten the plurality of the joist brackets 110 to the underside of the plurality of the joists of the deck. Detailed descriptions of these individual components are given in the following sections.

Figure 2B:
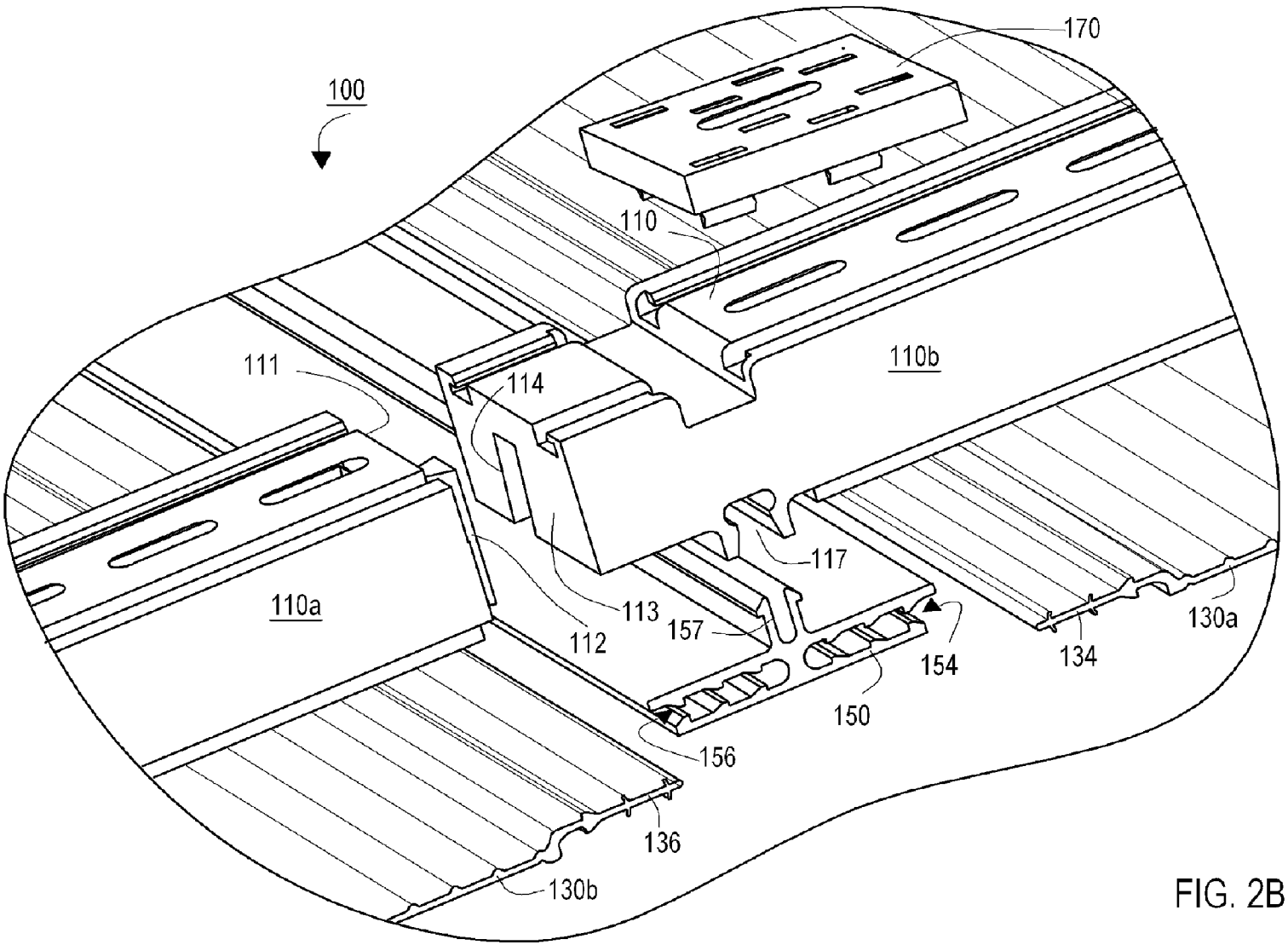

Referring now to FIG. 2B, a perspective view of the underdeck drainage system is shown according to one embodiment of the present invention. This drawing shows the relative positions of all necessary components as assembled to form such an underdeck drainage system. A dovetailed peg 112 of a first end 111 of a joist bracket 110*a* is slid into a dovetailed notch 114 of a second end 113 of another joist bracket 110*b* to form a joist bracket bar. This joist bracket attaching process continues until the joist bracket bar reaches a length substantially equal to the length of the deck assembly. Several joist bracket bars may be needed for the underdeck drainage system. The joist bracket bar is fastened with joist bracket screws 160 (not shown in FIG. 2B, see FIG. 2A) to the plurality of the joists of the deck assembly.

In order to affix the drainage panels 130 to a joist bracket bar, a first flange 134 of a drainage panel 130*a* is inserted into a first U-shaped notched receptacle 154 of a panel bracket 150, and a second flange 136 of another drainage panel 130*b* is inserted into a second U-shaped notched receptacle 156 of the panel bracket 150. The flanges may be snapped into place by direct insertion, or may be slidingly engaged. The drainage panels 130*a*, 130*b* and drainage panel brackets 150 form a water shield with an alternate pattern such as one drainage panel 130*a*, one drainage panel bracket 150, another drainage panel 130*b*, another drainage panel bracket 150, and so on. The U-shaped pegs 157 of the panel brackets 150 of this water shield are then installed into corresponding notched receptacles 117 of joist brackets 110, by snapping into place or by sliding engagement. Optionally, a plurality of the joist bracket spacers 170 can be installed between joists and the joist bracket bars to form a pitch for the drainage panels 130.

Figure 3A:
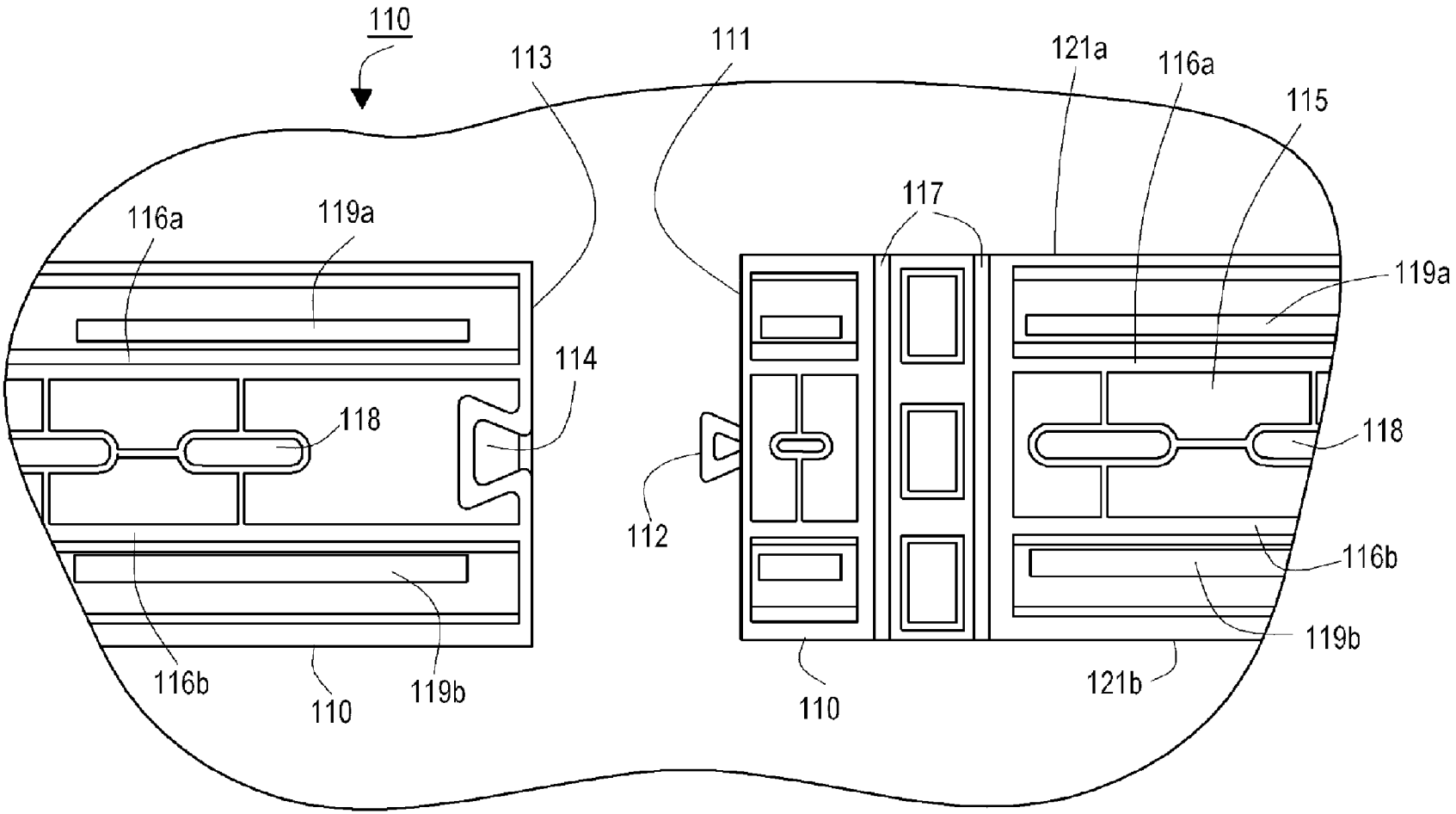
FIG. 3, consisting of FIGS. 3A, 3B, and 3C, respectively shows (A) a partial bottom view of a joist bracket, (B) a top perspective view of a joist bracket, and (C) a bottom perspective view of a joist bracket according to one embodiment of the present invention.

Referring now to FIG. 3A, a joist bracket 110 is shown in this bottom view of the joist bracket according to one embodiment of the present invention. The joist bracket 110 has a first end 111, an opposite second end 113, a first outer wall 121*a*, an opposite second outer wall 121*b*, a body 115 formed between the first end 111 and the second end 113, a bottom portion 115*a* (not shown in FIG. 3A, see FIG. 3B), an opposite top portion 115*b* (not shown in FIG. 3A, see FIG. 3B), at least one dovetailed peg 112 formed on the first end 111, and at least one dovetailed notch 114 formed on the second end 113, such that when two joist brackets 110 are joined, the at least one dovetailed peg 112 of one joist bracket 110 is received in and engaged with the at least one dovetailed notch 114 of another joist bracket 110.

According to an aspect of the invention, a joist bracket 110 also includes a plurality of notched receptacles 117 extending across the width of the bracket from a bottom portion 115*a* of the body 115 at a predetermined position and adapted for receiving the U-shaped pegs of a drainage panel bracket 150. According to another aspect, a joist bracket 110 also includes a pair of notched grooves 119*a* and 119*b* extending lengthwise along the top portion 115*b* adapted for attaching one or more joist bracket spacers 170 (not shown in FIG. 3) for setting a pitch of the drainage panels 130, a plurality of spaced-apart obround openings 118 regularly formed on the top portion 115*b* adapted for fastening the joist bracket to the underside of the deck assembly with joist bracket screws 160, and a pair of inner reinforcement walls 116*a* and 116*b*.

When the joist brackets 110 of this aspect are in use, they are joined together by sliding the dovetailed peg 112 of the first end 111 of one joist bracket 110 to the dovetailed notch 114 of the second end of 113 of another joist bracket 110 to form a joist bracket bar in a length substantially equal to the length of the deck assembly. Several joist bracket bars may be needed to form the underdeck drainage system. More joist bracket bars may be required for a large size deck assembly and the joist bracket bars are spaced at a predetermined distance for supporting the drainage panels 130.

Figure 3B:
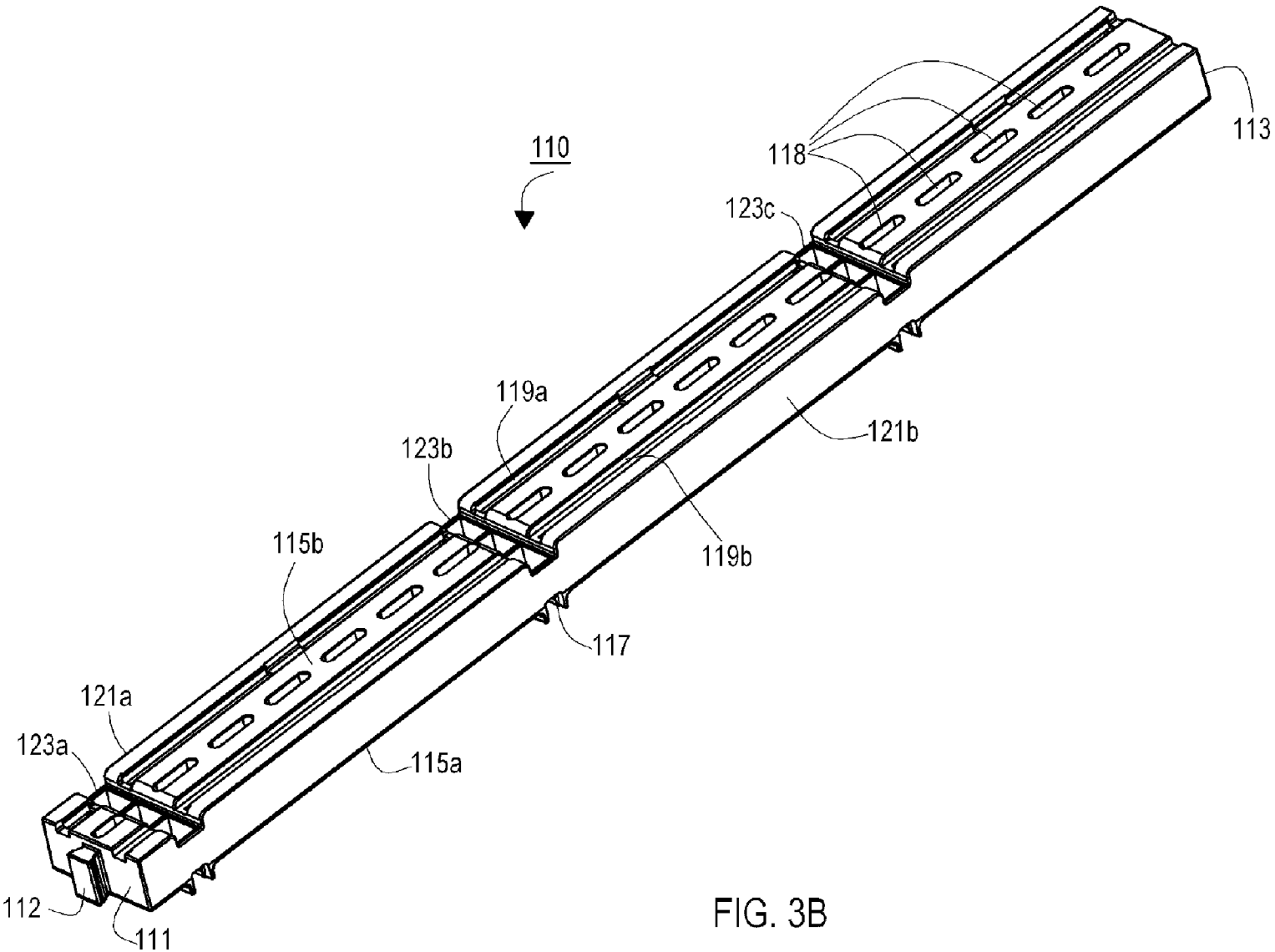

FIG. 3B is a top perspective view of a joist bracket 110. The first outer wall 121*a* and the top portion 115*b* of the joist bracket 110 are shown. A plurality of the grooves 123*a*, 123*b*, and 123*c* are formed on the top portion 115*b*, extending widthwise in the same lengthwise locations as the plurality of the notched receptacles 117 to facilitate stacking a plurality of joist brackets when stored or for shipment.

Figure 8:
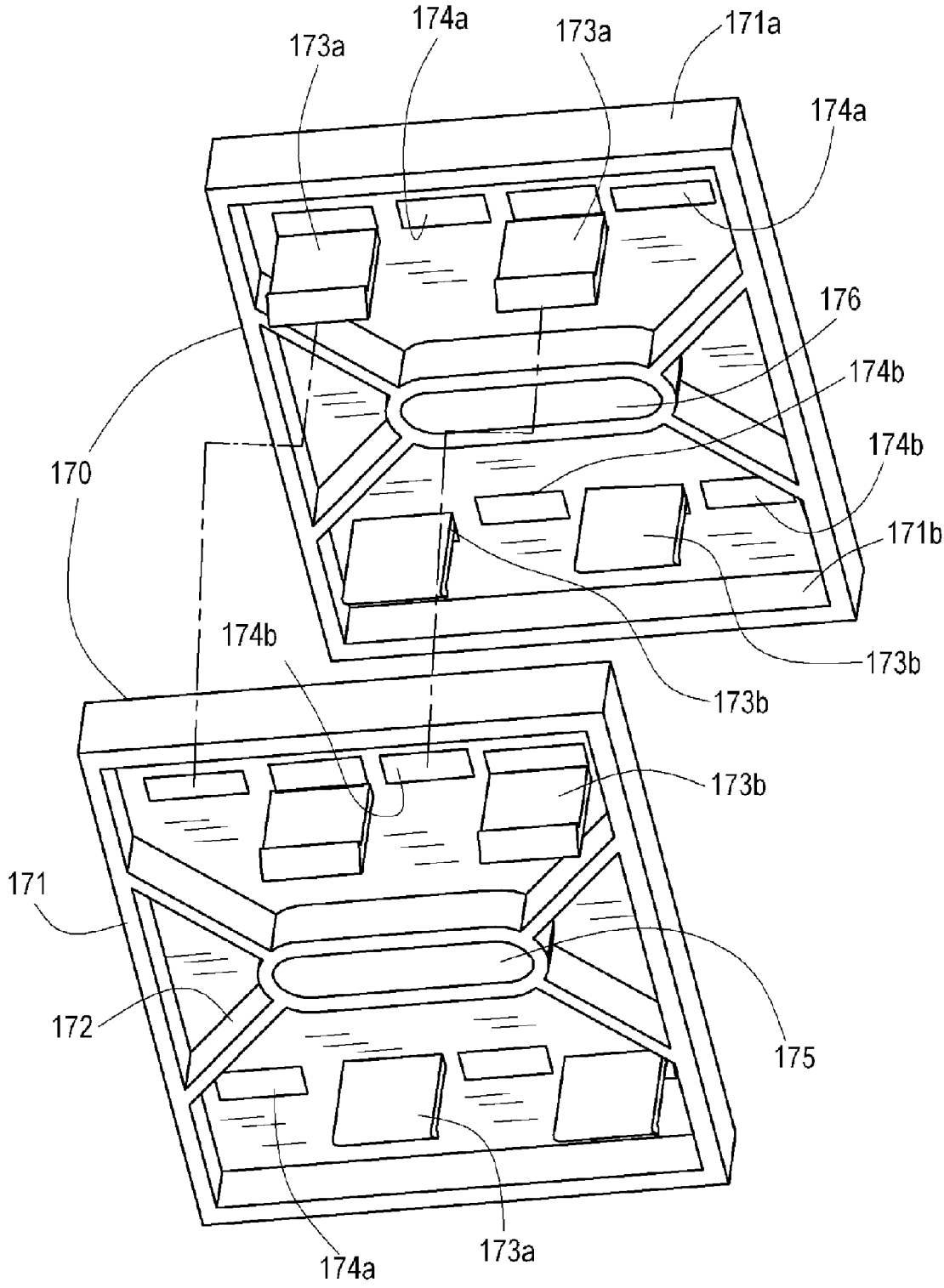
FIG. 8 is a perspective view of two joist bracket spacers and their relative positions when they are joined together to form a joist bracket spacer stack according to one embodiment of the present invention.
Figure 9:
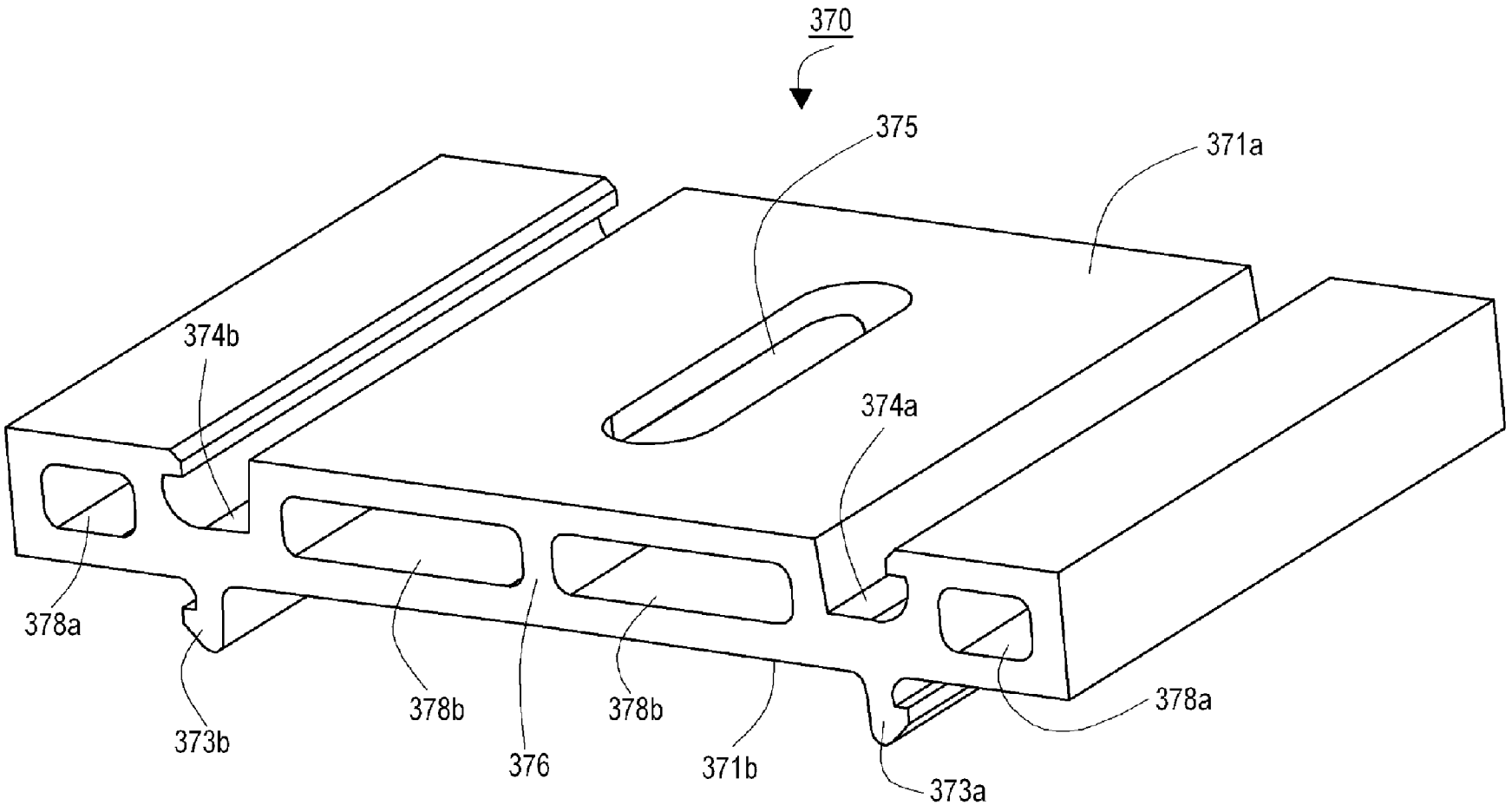
FIG. 9 is a perspective view of a joist bracket spacer according to another embodiment of the present invention.

The top portion 115*b* of the joist bracket 110 has a pair of notched grooves 119*a* and 119*b* extending lengthwise, for receiving a first pair of pegs 173*a* and a second pair of pegs 173*b* of the joist bracket spacers 170 (e.g. see FIG. 8) or a pair of notched pegs of a joist bracket spacer 370 (e.g. see FIG. 9). In the center of the top portion 115*b*, a plurality of obround openings 118 are formed for fastening the joist bracket 110 with joist bracket screws 160.

Figure 3C:
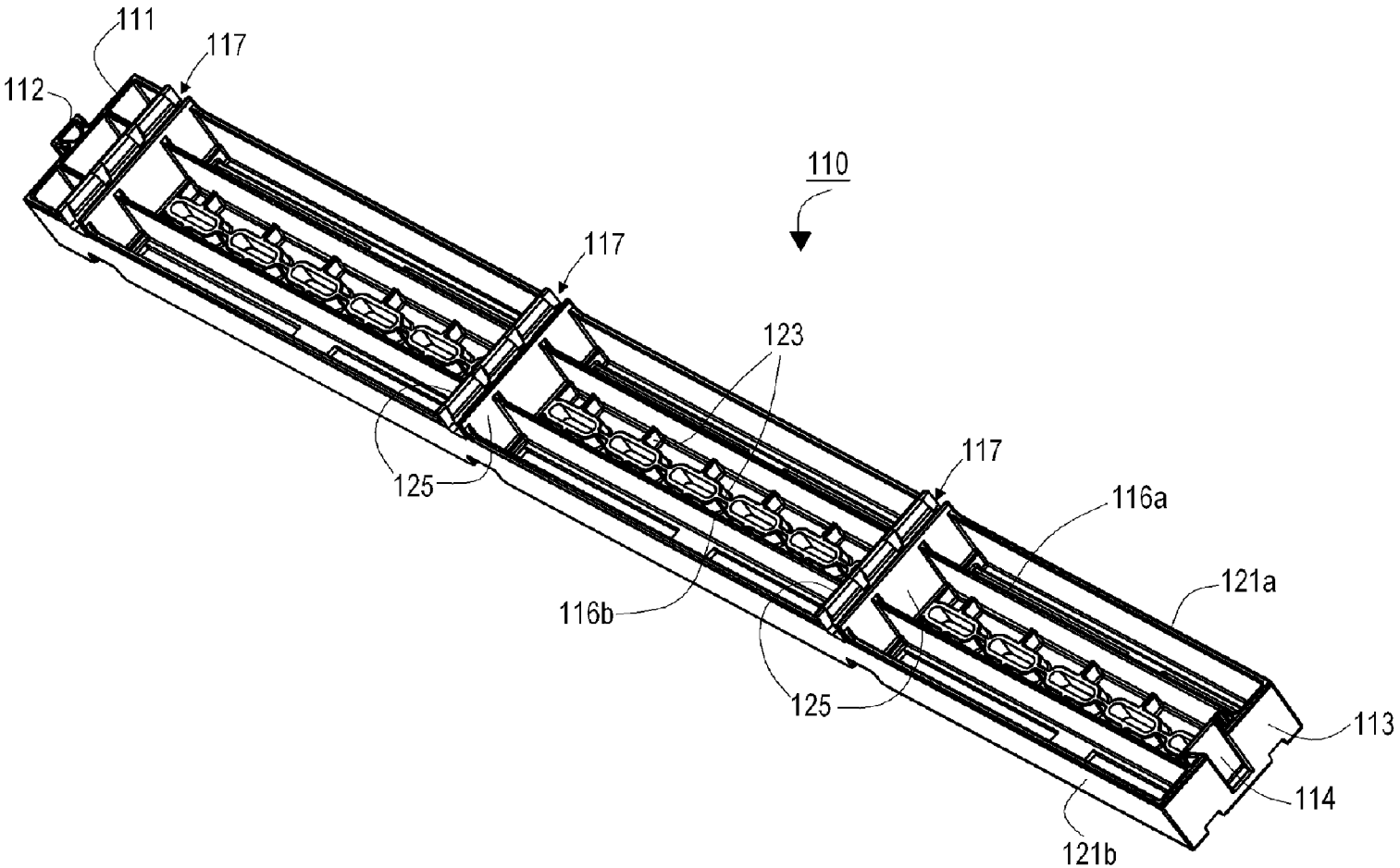

FIG. 3C is a bottom perspective view of a joist bracket 110. The cross-section of the joist bracket 110 is shaped generally like a U with two reinforcement walls 116*a* and 116*b* extending lengthwise in between the two outer walls 121*a* and 121*b*. The plurality of the notched receptacles 117 are supported by a pair of notched receptacle support walls 125 extending widthwise and through the top portion 115*b*. A plurality of support walls 123 are formed around the obround openings 118 for further strengthening the top portion 115*b*.

Figure 4:
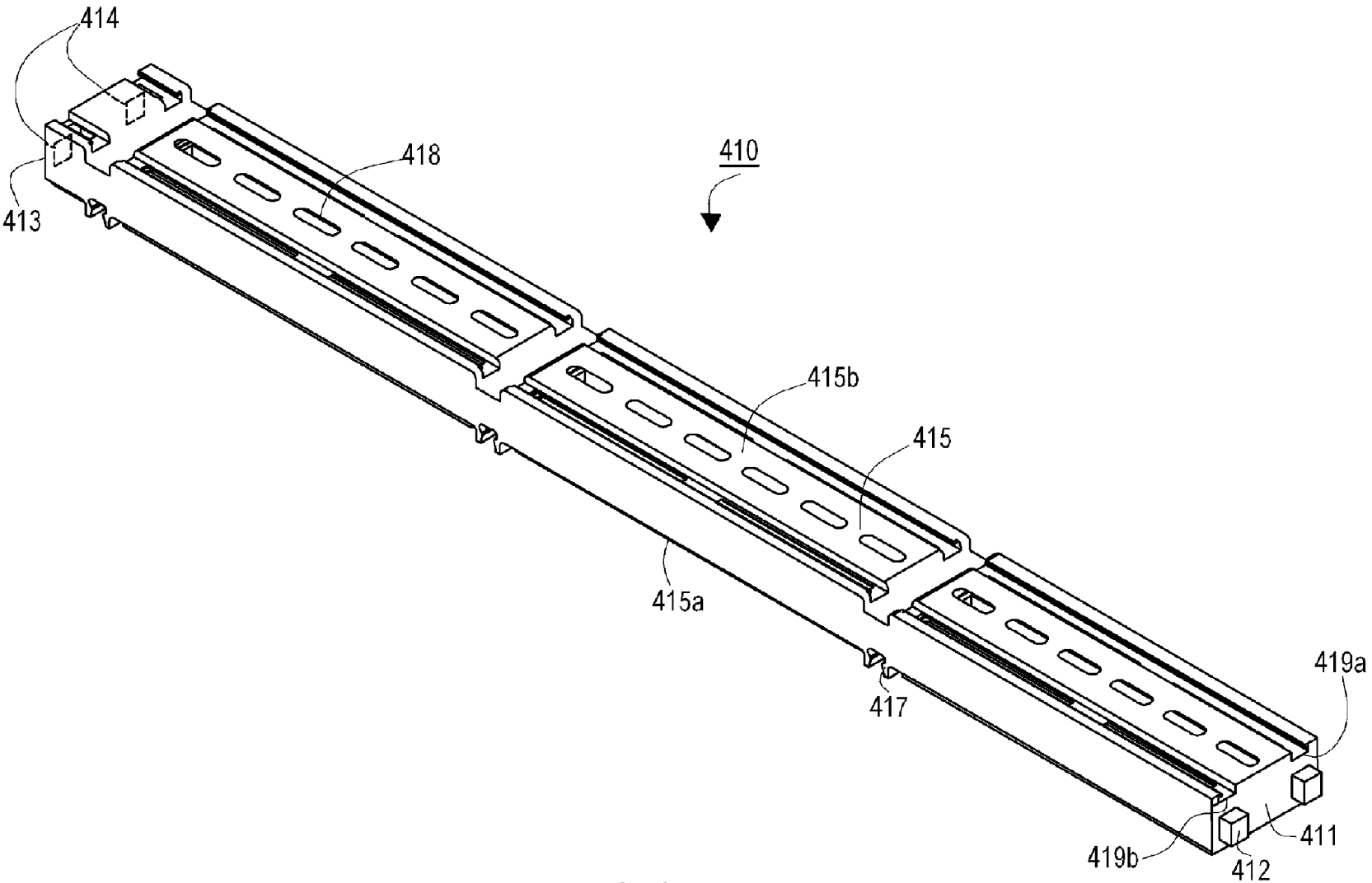
FIG. 4 is a top perspective view of a joist bracket according another embodiment of the present invention.

FIG. 4 illustrates a joist bracket 410 is shown according to another embodiment of the present invention. The joist bracket 410 has a first end 411, an opposite second end 413, a top surface 415*b*, an opposite, underside surface 415*a*, a body 415 formed between the first end 411 and the second end 413, at least one tenon 412 formed on the first end 411 and at least one mortise 414 (shown in phantom) formed on the second end 413 such that when two joist brackets 410 of this type are joined, the at least one tenon 412 of a joist bracket 410 is received in and engaged with the at least one mortise 414 of another joist bracket 410.

A joist bracket 410 of the type shown in FIG. 4 also preferably includes a plurality of notched receptacles 417 protruded from an underside surface 415*a* of the body 415 at a predetermined position adapted for receiving the U-shaped pegs 157 of a drainage panel bracket 150, a plurality of obround openings 418 adapted for fastening the joist bracket to the underside of the deck assembly with joist bracket screws 160, a pair of longitudinally extending notched grooves 419*a* and 419*b* adapted for receiving a first pair of pegs 173*a* and a second pair of pegs 173*b* of a joist bracket spacer 170 for setting a pitch for the drainage panels 130.

When the joist brackets 410 are in use, they are snapped together by joining the first end 411 of a joist bracket 410 to the second end of 413 of another joist bracket 410 to form a joist bracket bar in a length substantially equal to the length of the deck assembly. Several joist bracket bars may be needed to form the underdeck drainage system. More joist bracket bars may be required for large size deck assembly and the joist bracket bars are spaced at a predetermined distance for supporting the drainage panels 130.

Figure 5:
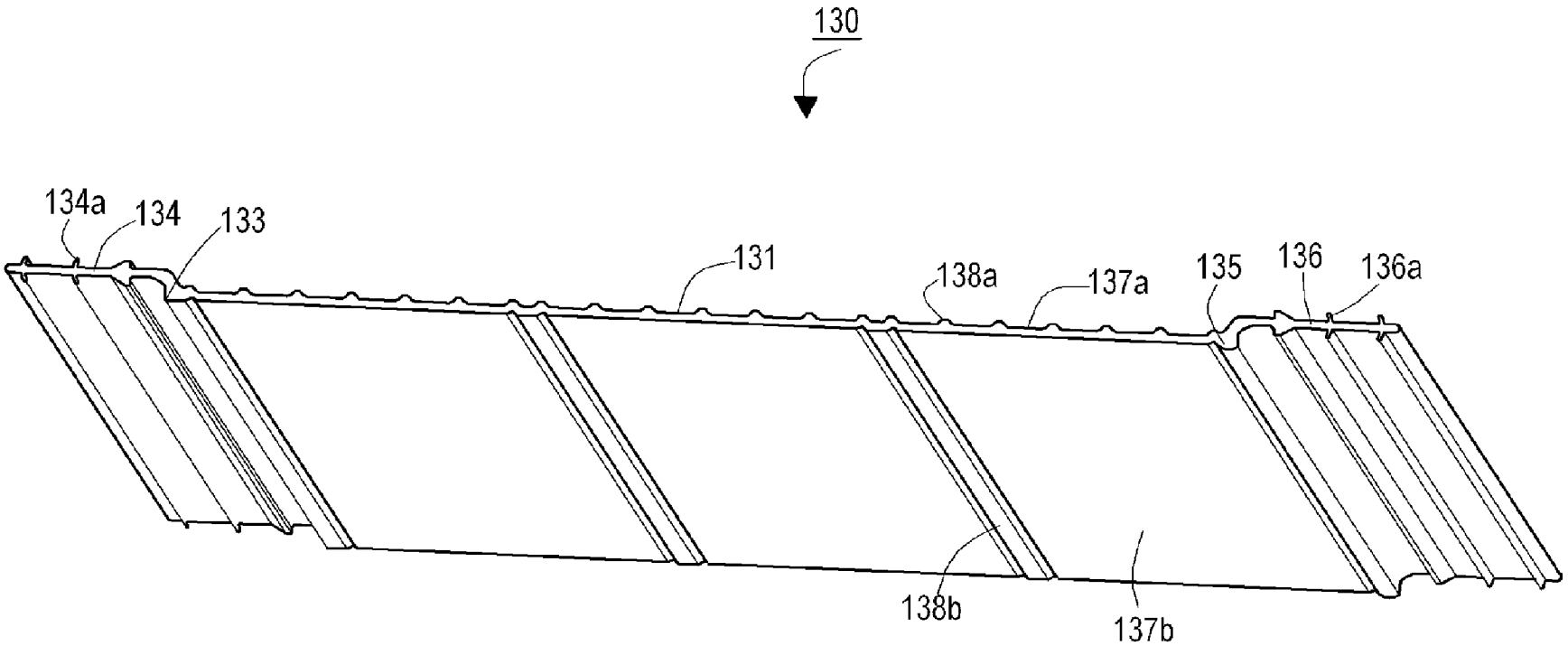
FIG. 5 is a perspective view of a portion of a drainage panel according to one embodiment of the present invention.

Referring now to FIG. 5, a drainage panel 130 is shown according to one embodiment of the present invention. The drainage panel 130 has a length, a width, a first surface 137*a*, an opposite second surface 137*b*, a plurality of drainage channels 131 formed by a plurality of ridges 138*a* on the first surface 137*a* extending lengthwise adapted for channeling water from the spaces between the deck boards toward a gutter system, a plurality of ridges 138*b* formed on the second surface 137*b* extending lengthwise for both decorative purposes and/or further strengthening the drainage panels 130.

The drainage panel 130 also includes a first flange 134 and a second flange 136 extending widthwise from a first lateral end 133 and an opposite, second lateral end 135 of the corresponding drainage panel 130, respectively. Each of the first flange 134 and the second flange 136 has a number of protrusions 134*a* (136*a*) formed lengthwise on flange surfaces for inter-locking the flanges 134 or 136 of the drainage panels 130 to the receiving grooves 154 or 156 of a panel bracket 150.

Figure 6:
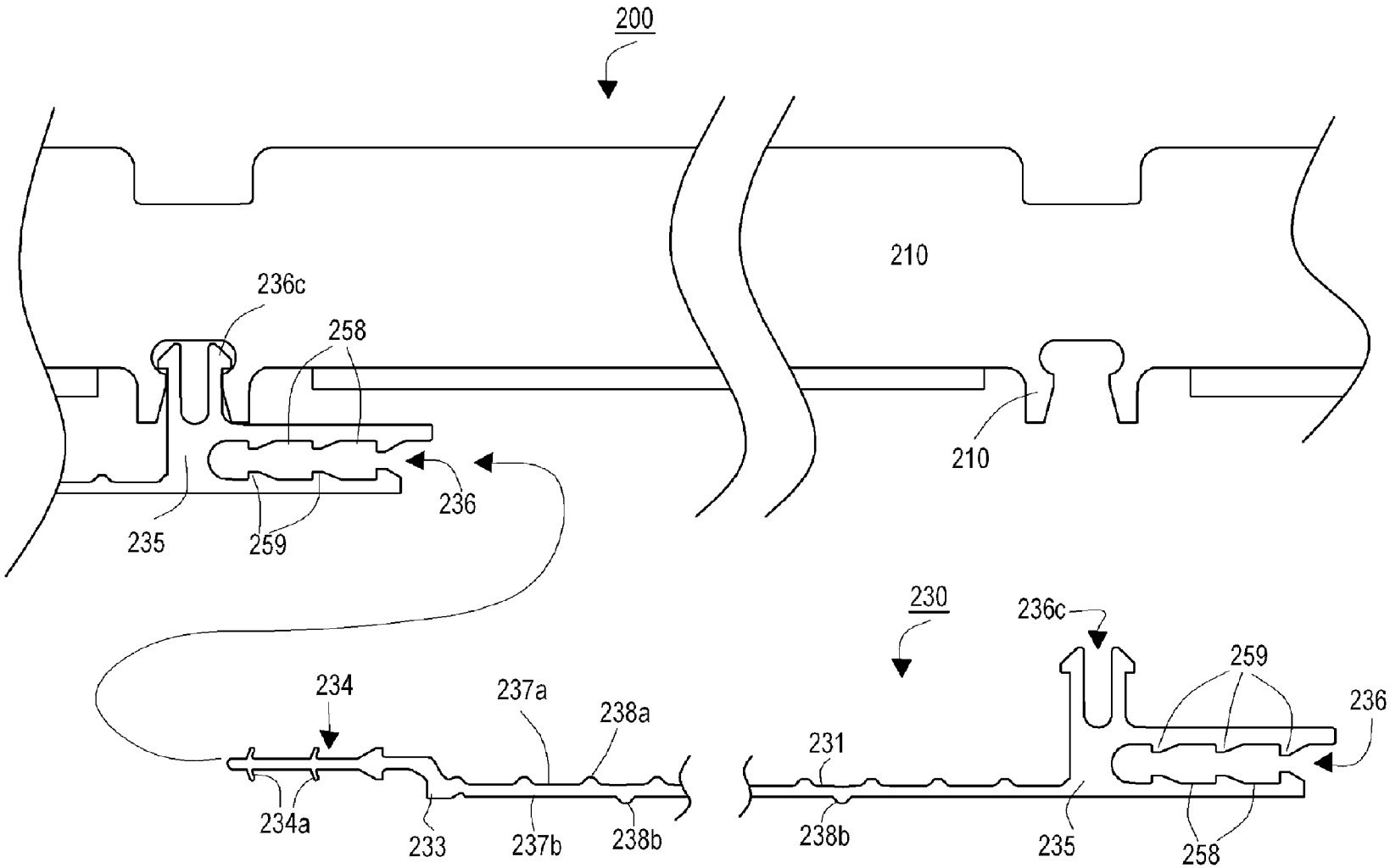
FIG. 6 is a side view of a portion of a drainage panel according to another aspect of the invention.

Referring now to FIG. 6, a drainage panel 230 according to another embodiment of the present invention is shown. According to this aspect of the invention, the drainage panel 230 has a length, a width, a first surface 237*a* and an opposite second surface 237*b*, a plurality of drainage channels 231 formed by a plurality of ridges 238*a* on the first surface 237*a* extending lengthwise for channeling water from the spaces between the deck boards downward to a gutter system, a plurality of ridges 238*b* formed on the second surface 237*b* extending lengthwise for decorative purposes and/or further strengthening the drainage panels 230, a flange 234 on one side of the drainage panel 230 extending widthwise from a first lateral end 233, and a U-shaped panel bracket 236 on the opposite side extending widthwise from a second lateral end 235, respectively.

The flange 234 has a number of grooves 258 defined by spaced apart trapezoidal protrusions 259, each of which has a sloped leading edge and a generally vertical trailing edge to engage with and "catch" protrusions 234*a* on a drainage panel 230. Each drainage panel has a number of protrusions 234*a* formed lengthwise on both flange surfaces for inter-locking the flanges 234 of the drainage panels 230 to the U-shaped notched receptacle 236 of another drainage panel 230. When a drainage panel 230 is inserted, the number of protrusions 234*a* on both flange surfaces of the drainage panel 230 are received in and engaged with the number of grooves 258.

According to this aspect of the invention, the panel bracket 236 has a plurality of protrusions 258 formed lengthwise on both inner surfaces of the U-shaped panel bracket 236 for receiving the flanges 234 of another adjacent drainage panel 230, and a pair of U-shaped pegs 236*c* protruding perpendicularly and lateral end 235. The flange 234 and the U-shaped panel bracket 236 are designed to inter-lock adjacent drainage panels 230. The protrusions 234 properly installed. The U-shaped pegs 236*c* are used to attach the connected drainage panels 230 to the notched receptacles 117 of the joist brackets 110.

Figure 7:
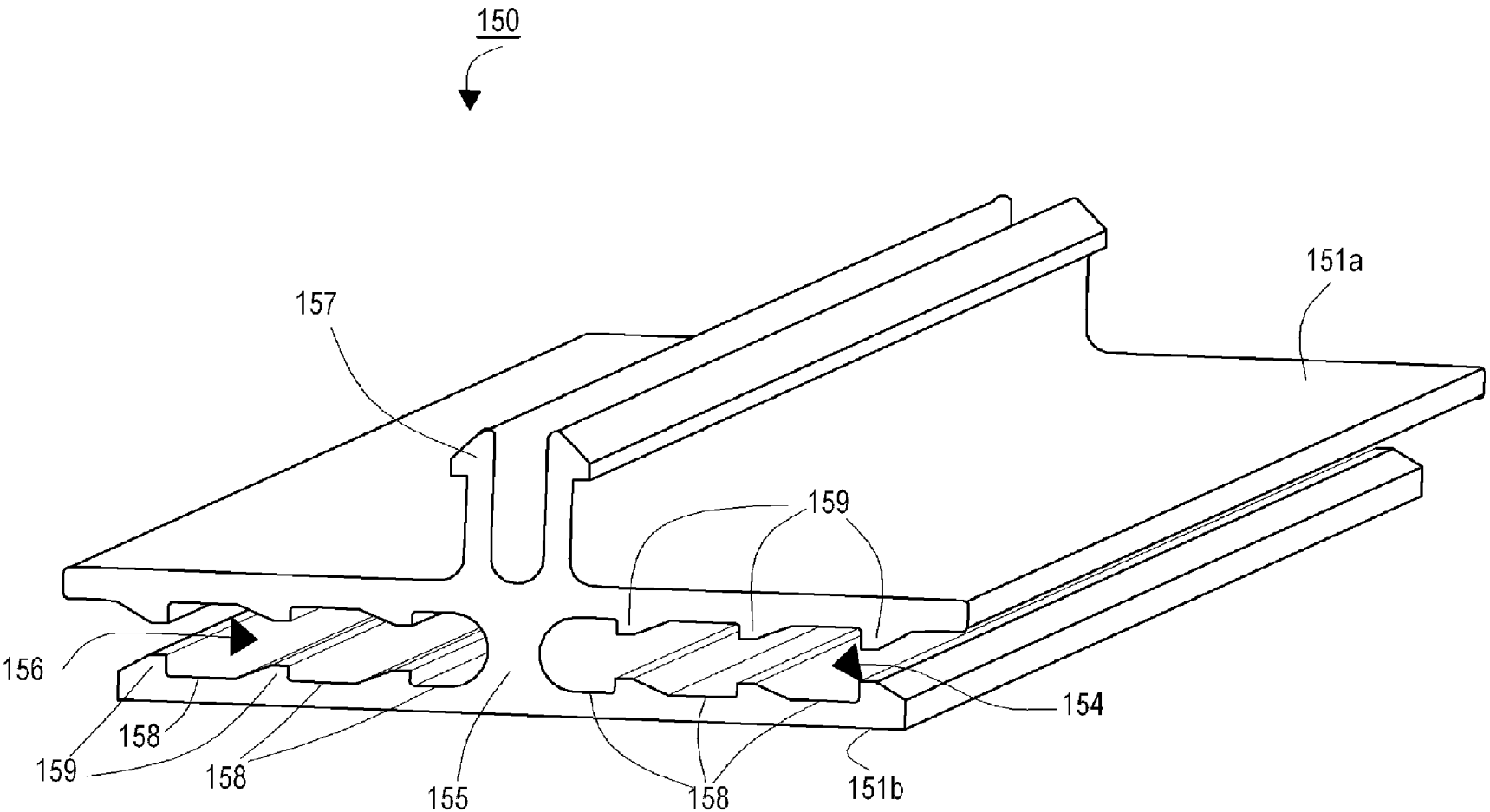
FIG. 7 is a perspective view of a portion of a drainage panel bracket according to one embodiment of the present invention.

Referring now to FIG. 7, a panel bracket 150 is shown according to one embodiment of the present invention. The panel bracket 150 has a length, a first surface 151*a*, an opposite second surface 151*b*, a U-shaped peg 157 lengthwise protruding from and perpendicular to the first surface 151*a*, a first U-shaped notched receptacle 154 and a second U-shaped notched receptacle 156 extending widthwise and in opposite direction from the bracket center 155. Each of the first U-shaped notched receptacles 154 and the second U-shaped notched receptacles 156 has a number of grooves 158 defined by spaced apart trapezoidal protrusions 159, each of which has a sloped leading edge and a generally vertical trailing edge to engage with and "catch" protrusions 134*a*, 136*a* on the drainage panels 130 (not shown in FIG. 7). When a drainage panel 130 is inserted, the number of protrusions 134*a*, 136*a* on both flange surfaces of the drainage panel 130 are received in and engaged with the number of grooves 158. The two U-shaped notched receptacles 154 and 156 are used to connect the adjacent drainage panels together, one on each side. The U-shaped peg 157 is formed such that when the panel bracket 130 installed onto the drainage panel bracket 150 and further attached to the notched receptacle 117 of a joist bracket 110, where the U-shaped peg 157 is received in and engaged with notched receptacle 117 of the joist bracket 110.

Referring now to FIG. 8, a joist bracket spacer 170 is shown according to one embodiment of the present invention. The joist bracket spacer 170 has a frame 171, an obround ring 176 forming an obround opening 175, a plurality of ribs 172 connecting the ring 176 and the frame 171 at an angle, a first end portion 171*a*, an opposite second end portion 171*b*, a first pair of openings 174*a* and a first pair of pegs 173*a* formed near the first end portion 171*a*, and a second pair of openings 174*b* and a second pair of pegs 173*b* formed near the second end portion 171*b*. The first pair of pegs 173*a* and the second pair of pegs 173*b* are respectively offset from the first pair of openings 174*a* and the second pair of openings 174*b* such that when two joist bracket spacers 170 are joined by rotating successive spacers 180 degrees, the first pair of pegs 173*a* and the second pair of pegs 173*b* of a joist bracket spacer 170 are received in and engaged with a first pair of openings 174*a* and the second pair of openings 174*b* of another joist bracket spacer 170, respectively.

As generally can be seen in FIG. 1 and FIG. 2, the first pair of pegs 173*a* and the second pair of pegs 173*b* of one of the plurality of joist bracket spacers 170 can also be received in and engaged with a pair of notched grooves 119*a* and 119*b* of one of the plurality of joist brackets 110, respectively.

Still referring to FIG. 8, the opening 175 of spacer 170 is used by the joist bracket screws 160 for fastening the joist bracket 110 to the underside of the deck system. The ribs 172 strengthen and support the ring 176 and the frame 171. The spacers 170 are formed with offset snap openings 174*a* and 174*b* for receiving pegs 173*a* and 173*b* of a corresponding adjacent spacer. By rotating successive spacers 180 degrees, the spacers can be snapped together in a stack to create a desired pitch of the drainage panels 130 for draining water.

Another embodiment of a joist bracket spacer 370 is shown in FIG. 9. A joist bracket spacer 370 according to this aspect comprises a first surface 371*a*, an opposite second surface 371*b*, an obround opening 375 formed through the first surface 371*a* and the second surface 371*b* at a predetermined position, a pair of notched grooves 374*a* and 374*b* formed on the first surface 371*a*, and a pair of notched pegs 373*a* and

373*b* formed on the second surface 371*b* at corresponding positions of the pair of notched grooves 374*a* and 374*b*. When two joist bracket spacers 370 are joined, the pair of notched pegs 373*a* and 373*b* of one joist bracket spacer 370 are received in and engaged with the pair of notched grooves 374*a* and 374*b* of another joist bracket spacer 370, respectively. The pair of notched pegs 373*a* and 373*b* of one joist bracket spacer 370 can also be received in and engaged with a pair of notched grooves 119*a* and 119*b* of a joist bracket 110, respectively. The opening 375 is used by the joist bracket screws 160 for fastening the joist bracket 110 to the underside of a deck assembly. Optionally, a plurality of spaces or conduits 378*a* and 378*b* can be formed lengthwise to minimize the amount of material utilized.

Figure 10:
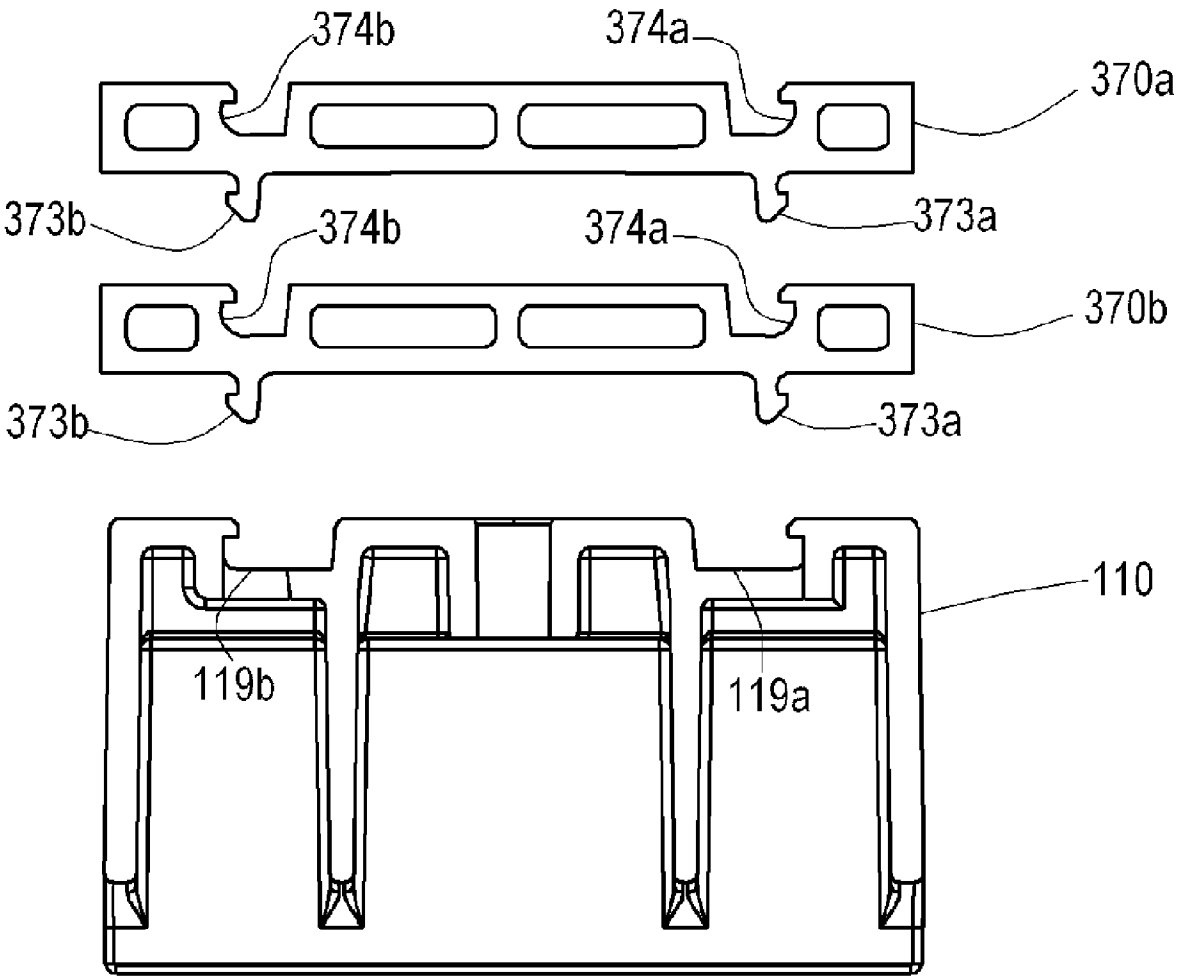
FIG. 10 is an exploded side view of the assembly of two joist bracket spacers and a joist bracket according to one embodiment of the present invention.

FIG. 10 shows a side view of the relative position of two joist bracket spacers 370 and a joist bracket 110 according to one embodiment of the present invention. One joist bracket 110 and two joist bracket spacers 370*a*, 370*b* are shown in place before they are attached. The pair of notched pegs 373*a* and 373*b* of the top joist bracket spacer 370*a* can be either slidingly engaged or snapped into the pair of notched grooves 374*a* and 374*b* of the second joist bracket spacer 370*b*, respectively. The pair of notched pegs 373*a* and 373*b* of the second joist bracket spacer 370*b* can also be either slidingly engaged or snapped into a pair of notched grooves 119*a* and 119*b* of a joist bracket 110, respectively. When they are properly installed, the pair of notched pegs 373*a* and 373*b* is securely engaged into the pair of notched grooves 374*a* and 374*b* of another joist bracket spacer 370 or the notched grooves 119*a* and 119*b* of the joist bracket 110. Any number of joist bracket spacers 370 can be used to reach a proper height for setting up a proper pitch for the drainage panels 130.

Figure 11:
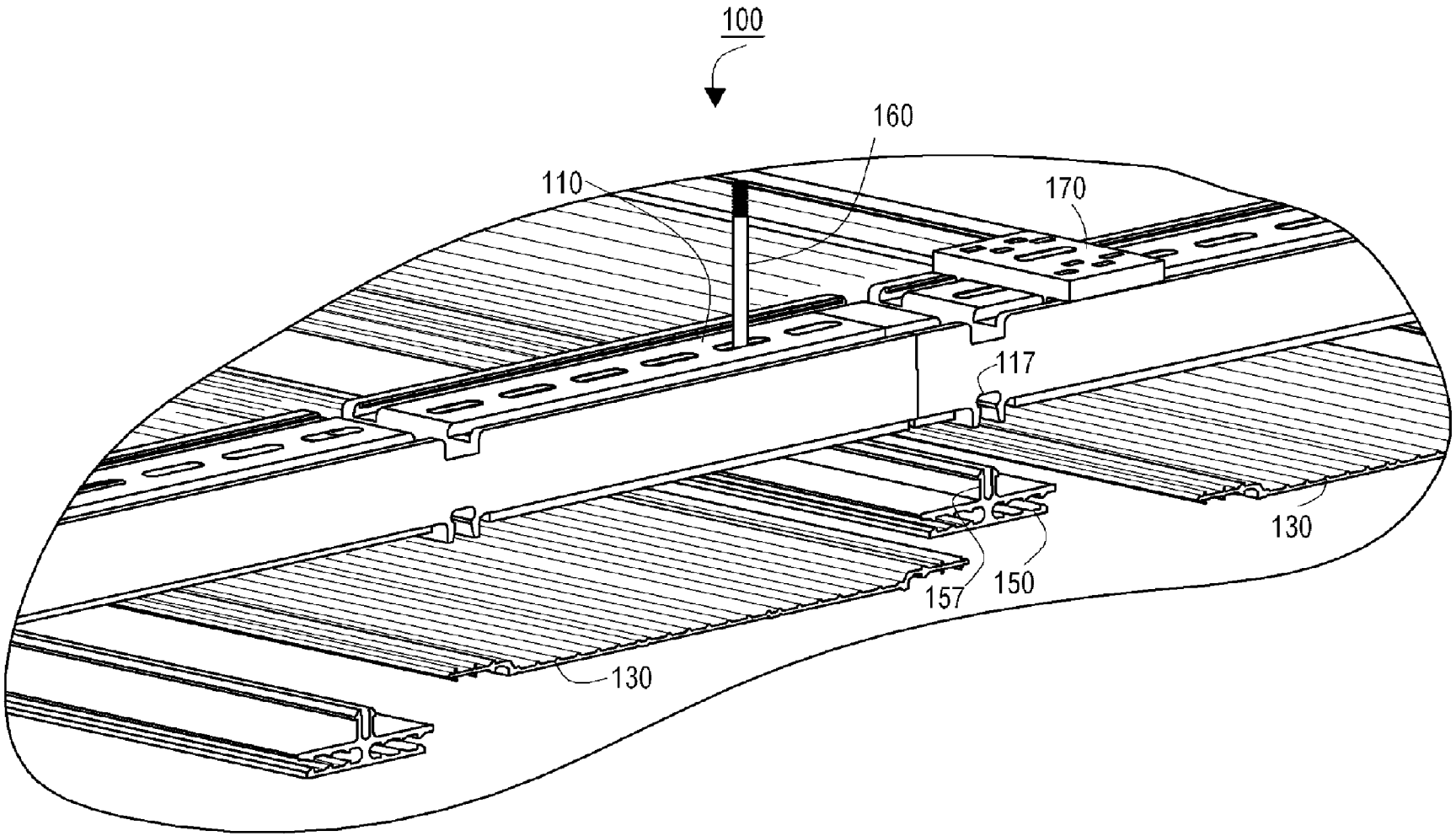
FIG. 11 is a partial and exploded perspective view of an underdeck drainage system and the relationship of each component according to a preferred embodiment of the present invention.

For a preferred embodiment, the components and their arrangement for an underdeck drainage system 100 are shown in FIG. 11. The joist bracket spacers 170 are placed between joist bracket 110 and the joists of a deck assembly (not shown). The joist brackets 110 are connected through their pegs 112 and notches 114 (not shown in FIG. 11, see FIGS. 3A, 3B and 3C) to form a joist bracket bar. The joist bracket bars are fastened with the joist bracket screws 160 to the underside of the joists of the deck assembly. The flanges 134 and 136 of drainage panels 130 are installed into the U-shaped notched grooves 154 and 156 of panel brackets 150 to form a water shield under the deck assembly and a surface for draining water from the deck above. This water shield is further attached to the under side of the deck assembly through the U-shaped pegs 157 of the panel brackets 150 to the U-shaped notched receptacles 117.

Figure 12:
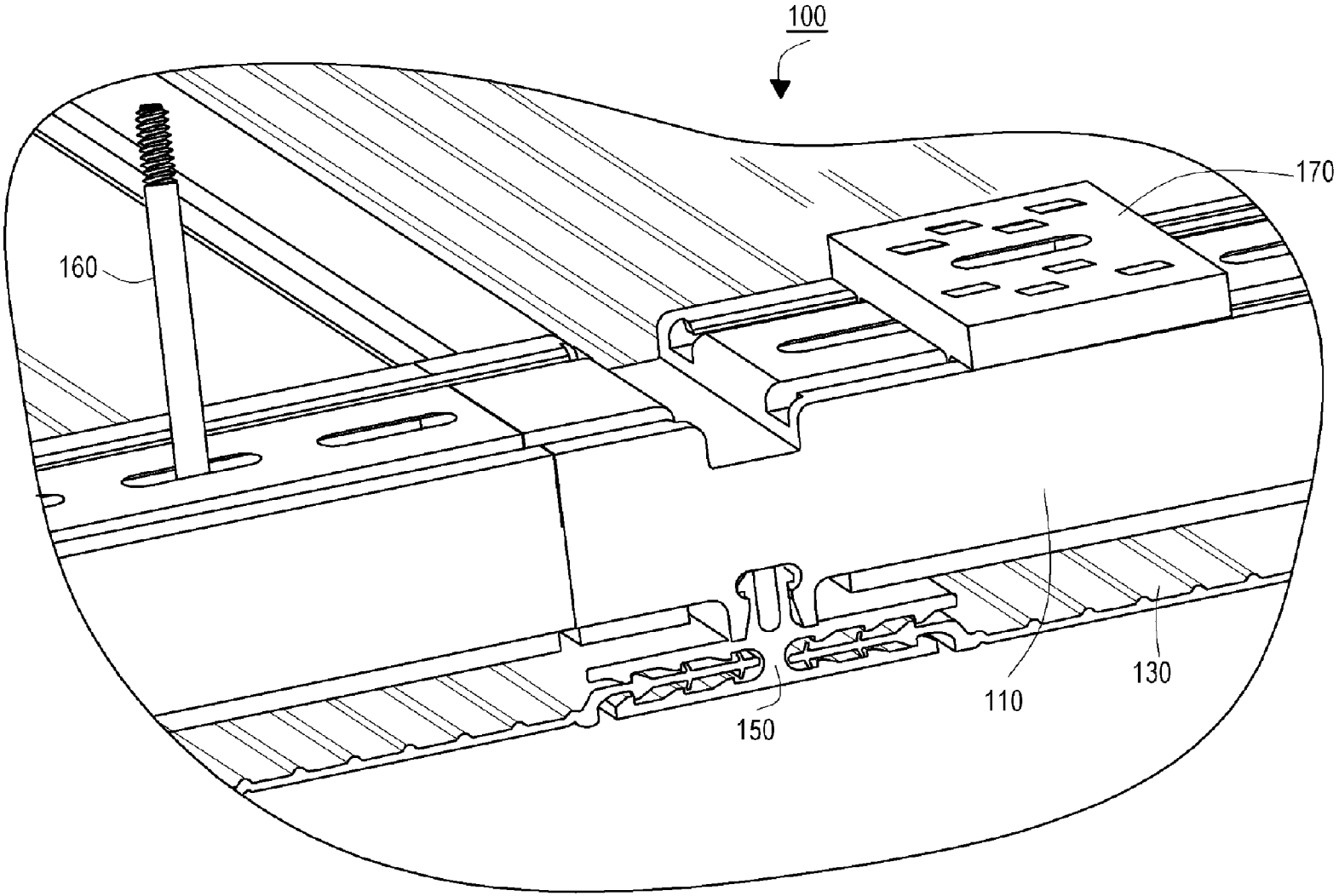
FIG. 12 is a partial perspective view of an underdeck drainage system assembled according to one embodiment of the present invention.

FIG. 12 is a partial perspective view of the assembled underdeck drainage system 100. An underdeck drainage system constructed in accordance with the various embodiments of the invention is designed to provide "do-it-yourself" homeowners or builders a quick, easy, and faulty-free installation.

Referring now to FIGS. 13A-13J, an exemplary assembling process is illustrated according one embodiment of the present invention.

(a). First, a plurality of joist bracket bars are assembled (see FIG. 13A). The tenons 412 at a first end 411 of a joist bracket 410*a* and the mortises 414 at a second end 413 of another joist brackets 410*b* are snapped together to form a plurality of joist bracket support bars so that the length of the joist bracket bars are substantially equal to the length of the deck and U-shaped pegs 417 are in the same longitudinal location. Although the embodiment of joist bracket 410 (FIG. 4) is used in this example, the other embodiment such as joist bracket 110 (FIG. 3) can also be used for such practice.

(b). Next, a plurality of joist bracket spacer stacks are formed (see FIG. 13B). A plurality of joist bracket spacers 370 are snapped together to form a series of joist bracket spacer stacks for successive joist bracket bars to set a pitch of the drainage panels 230. These joist bracket spacer stacks are installed between the joists of the deck assembly and joist bracket bars. In order to direct water away from a house, the joist bracket bar near a house requires no or fewer spacers 370, but the joist bracket bar near the gutter system usually requires a number o joist bracket spacers 370 to form the desired pitch for the drainage panels 230. Either joist bracket spacer embodiment 170 or embodiment 370 can be used here to form the joist bracket spacer stacks.

(c). Joist bracket spacers or joist bracket spacer stacks are then affixed to the joist bracket bars (see FIG. 13C). The joist bracket spacers 370 or the joist bracket spacer stacks are either slidingly engaged or snapped into the grooves 419*a* and 419*b* on the first surface 415*b* of the joist brackets 410*b* as shown, thereby securing the joist bracket spacer 370 to the joist bracket bar (joist brackets 410*a* and 410*b* joined). In this manner the pegs 373*a* and 373*b* (not shown in FIG. 13C) of the joist bracket spacers 370 or joist bracket spacer stacks are securely engaged into the grooves 419*a* and 419*b* of the joist bracket 410*b* to form a plurality of joist bracket spacer stack and joist bracket bar assembly, each of these assembly having successive and different height to set up a pitch for the drainage panel 230. The joist bracket spacer embodiment is not limited to 370 as described here. Other embodiments such as 170 can also be used as an alternative.

Figure 13A:
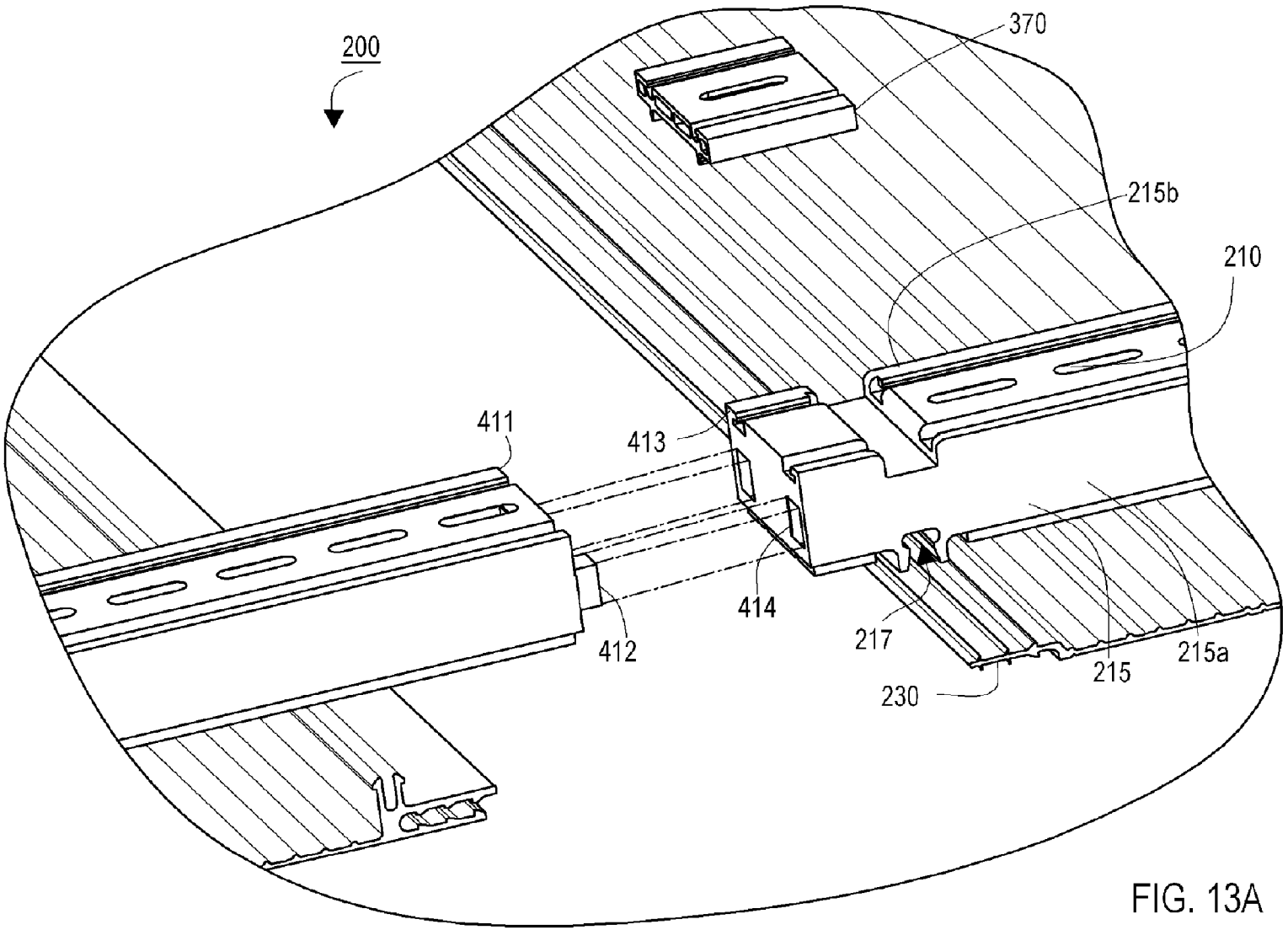
FIG. 13, consisting of FIGS. 13A-13J, illustrates an assembly procedure of an underdeck drainage system constructed according to certain aspects of the invention, namely, (A) engaging two joist brackets to form a joist bracket bar, (B) attaching a joist bracket spacer to a joist bracket, (C) attaching a joist bracket bar with a joist bracket spacer to an underside of a deck assembly, (D) aligning the neighboring joist bracket bars, (E) attaching a drainage panel to an underside of a joist bracket bar, (F) a partial perspective view of the drainage panel attached to the underside of the joist bracket bar, (G) engaging two adjacent drainage panels together, (H) a partial perspective view of two engaged drainage panels, (I) a partial top perspective view of an assembled underdeck drainage system and (j) a partial bottom perspective view of an assembled underdeck drainage system.
Figure 13B:
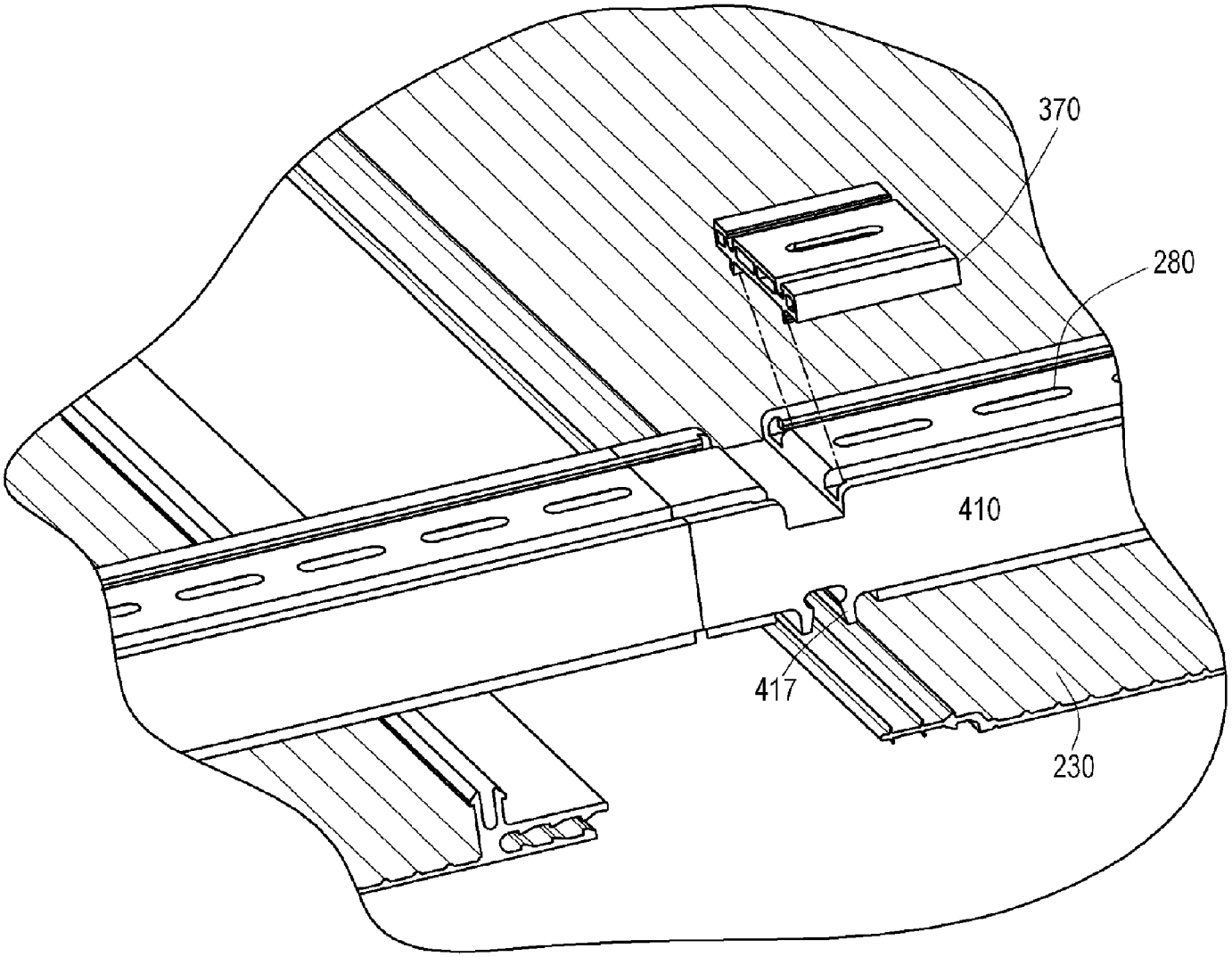
Figure 13C:
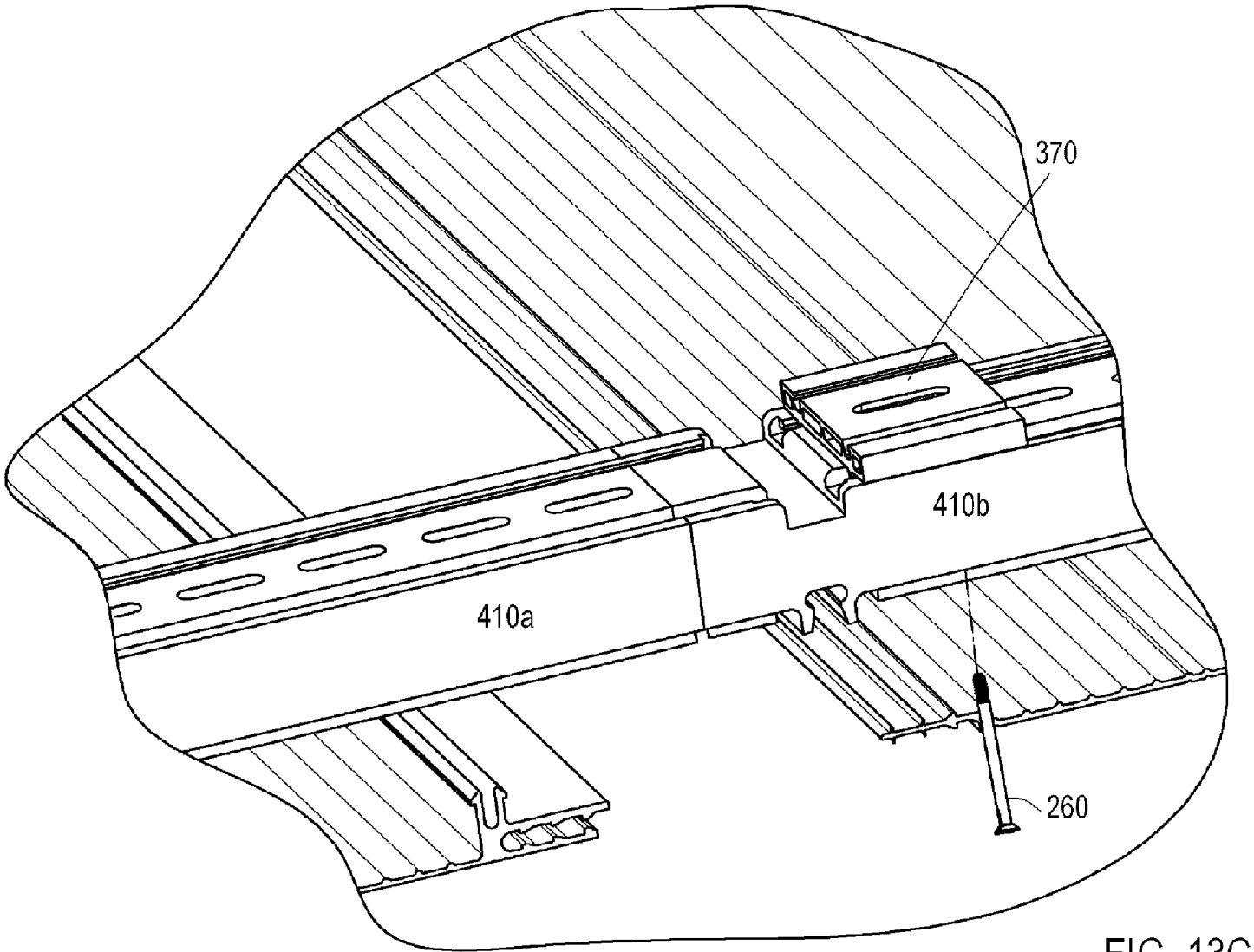
Figure 13D:
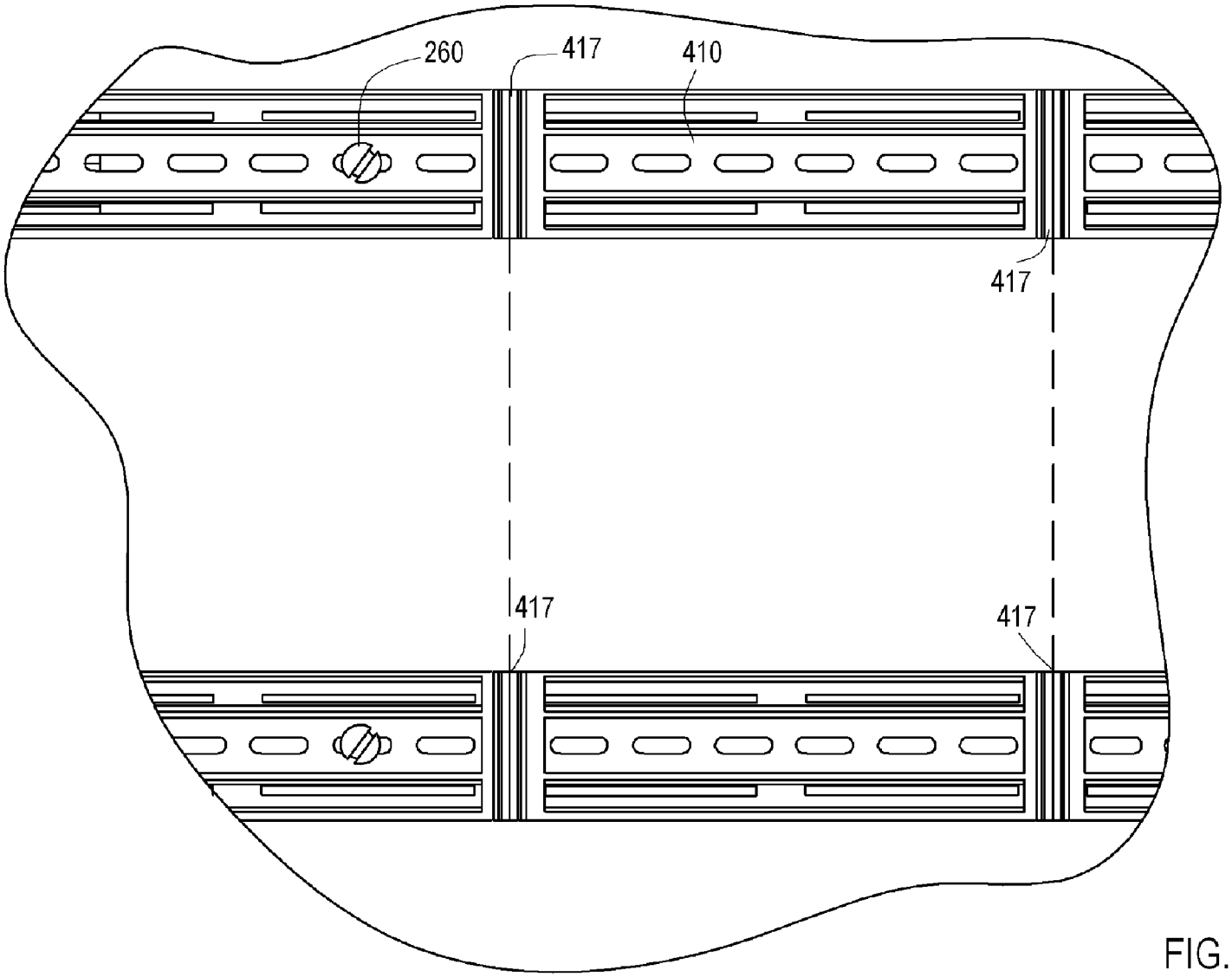

(d). The joist bracket bars are then fastened to the joists of a deck assembly (see FIG. 13C and 13D). The joist bracket spacer stacks and joist bracket bars assembly are fastened with a plurality of the joist bracket screws 260 to the underside of the deck joists. The plurality of the joist bracket screws 260 are preferably made of hot dipped galvanized or stainless steel and they are fastened at predetermined intervals. Optionally, a plurality of nails also be used to fasten the joist bracket bars to the deck joists. Referring now to FIG. 13D, a bottom view of the installed joist bracket spacer stacks and joist bracket bars assemblies is shown. The key to a proper installation of the underdeck drainage system is to align the notched receptacles 417 of the neighboring joist brackets 410 as shown in FIG. 13D.

Figure 13E:
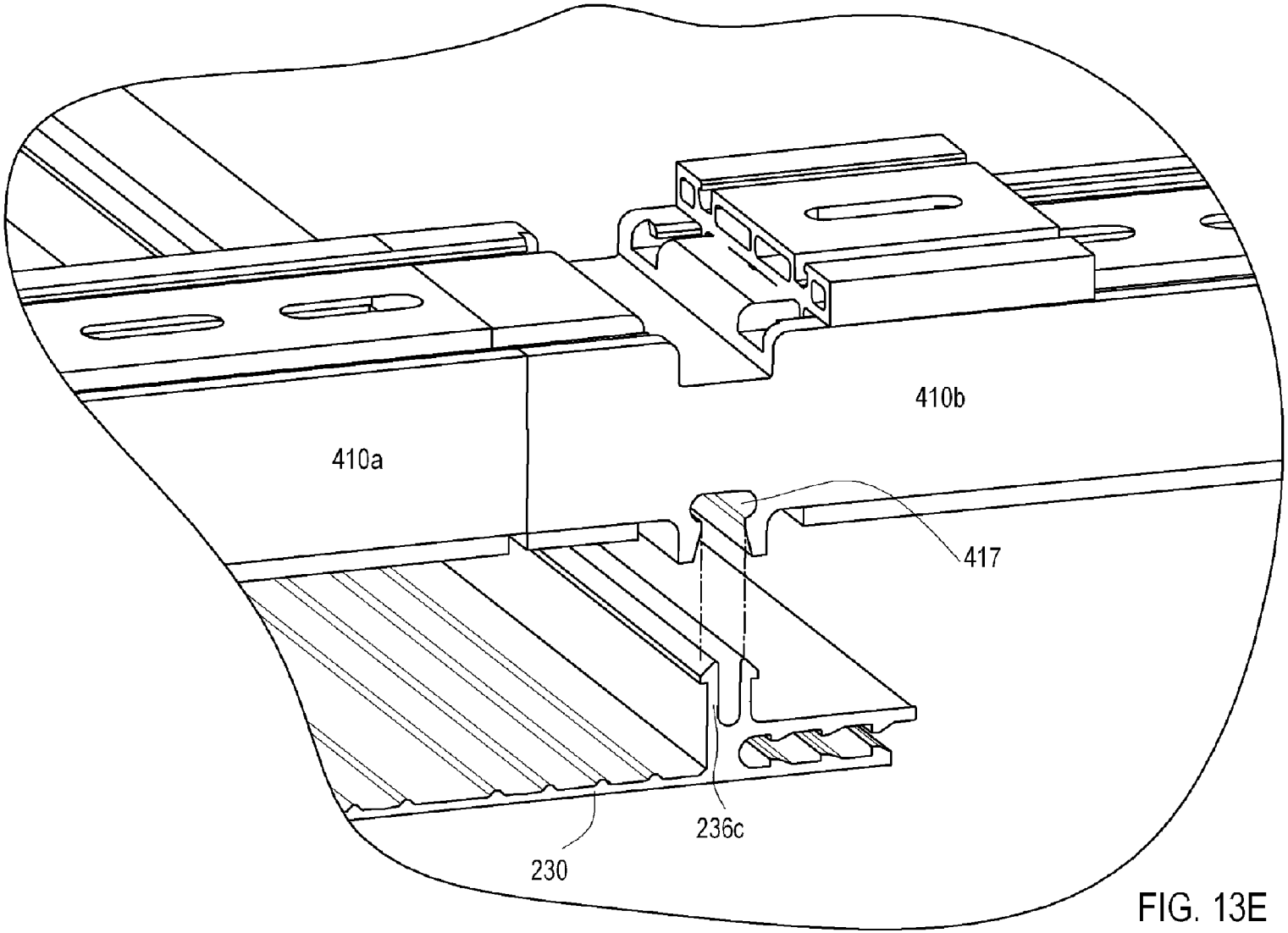
Figure 13F:
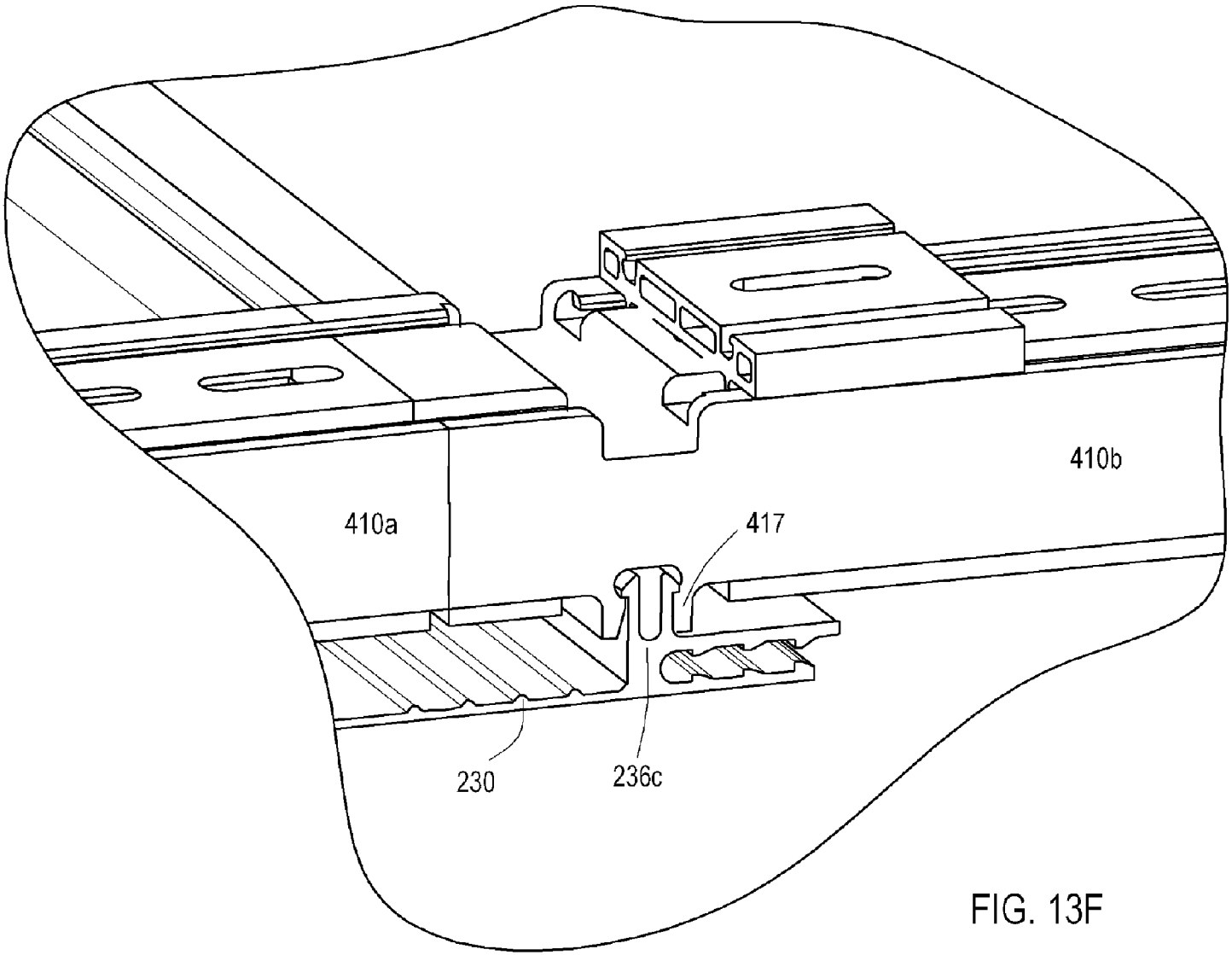
Figure 13G:
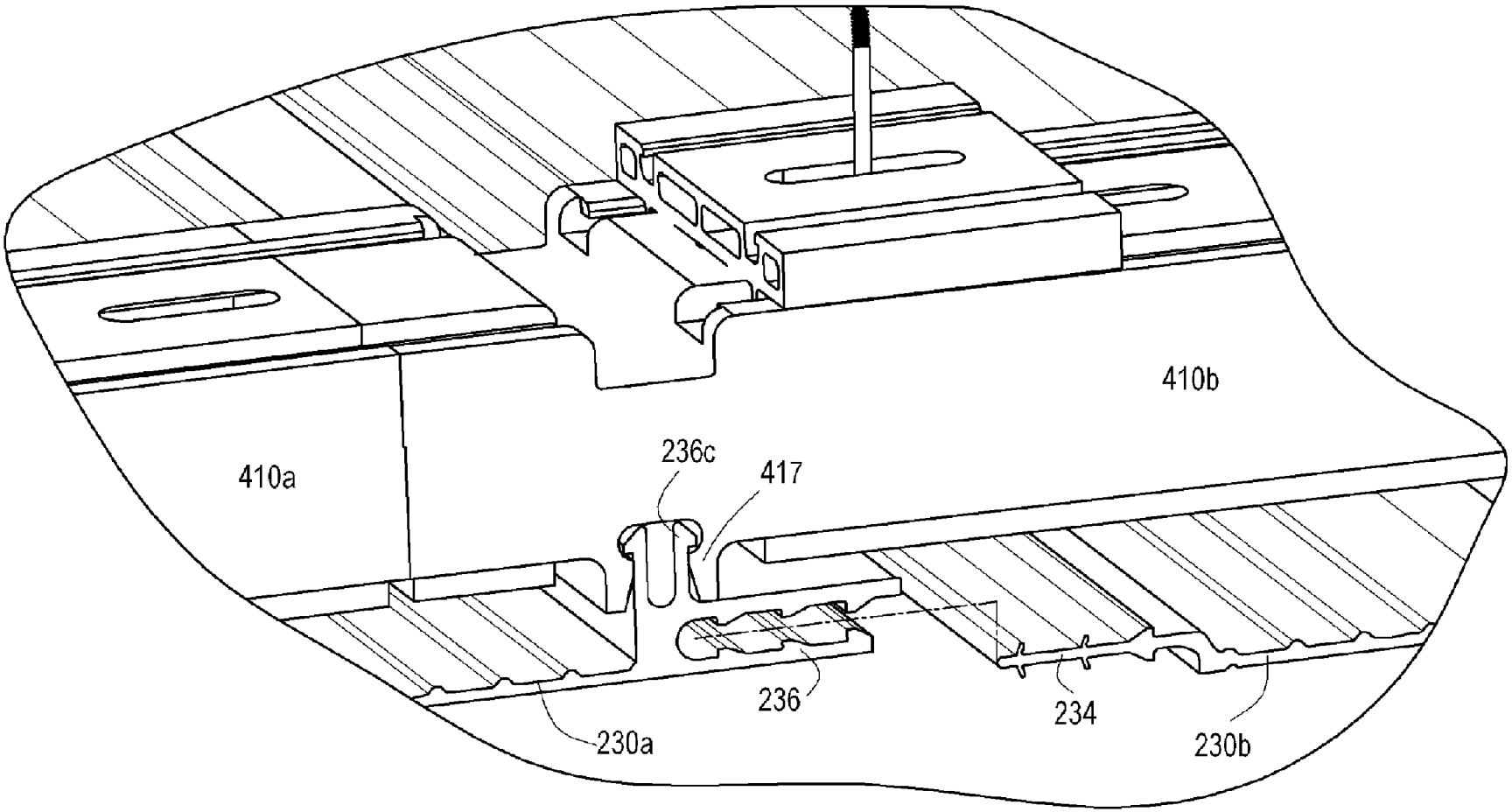

(e). A first drainage panel 230 is then installed (see FIGS. 13E and 13F). The U-shaped pegs 236*c* of the drainage panel 230 is slidingly engaged or snapped into the notched receptacle 417 of the joist bracket 410*b* above as shown in FIG. 13E. FIG. 13F shows a partial perspective view of the joist bracket 410 and the assembled drainage panel 230. Alternatively, drainage panel brackets 150 of another embodiment and the drainage panels 130 can be installed.

Figure 13H:
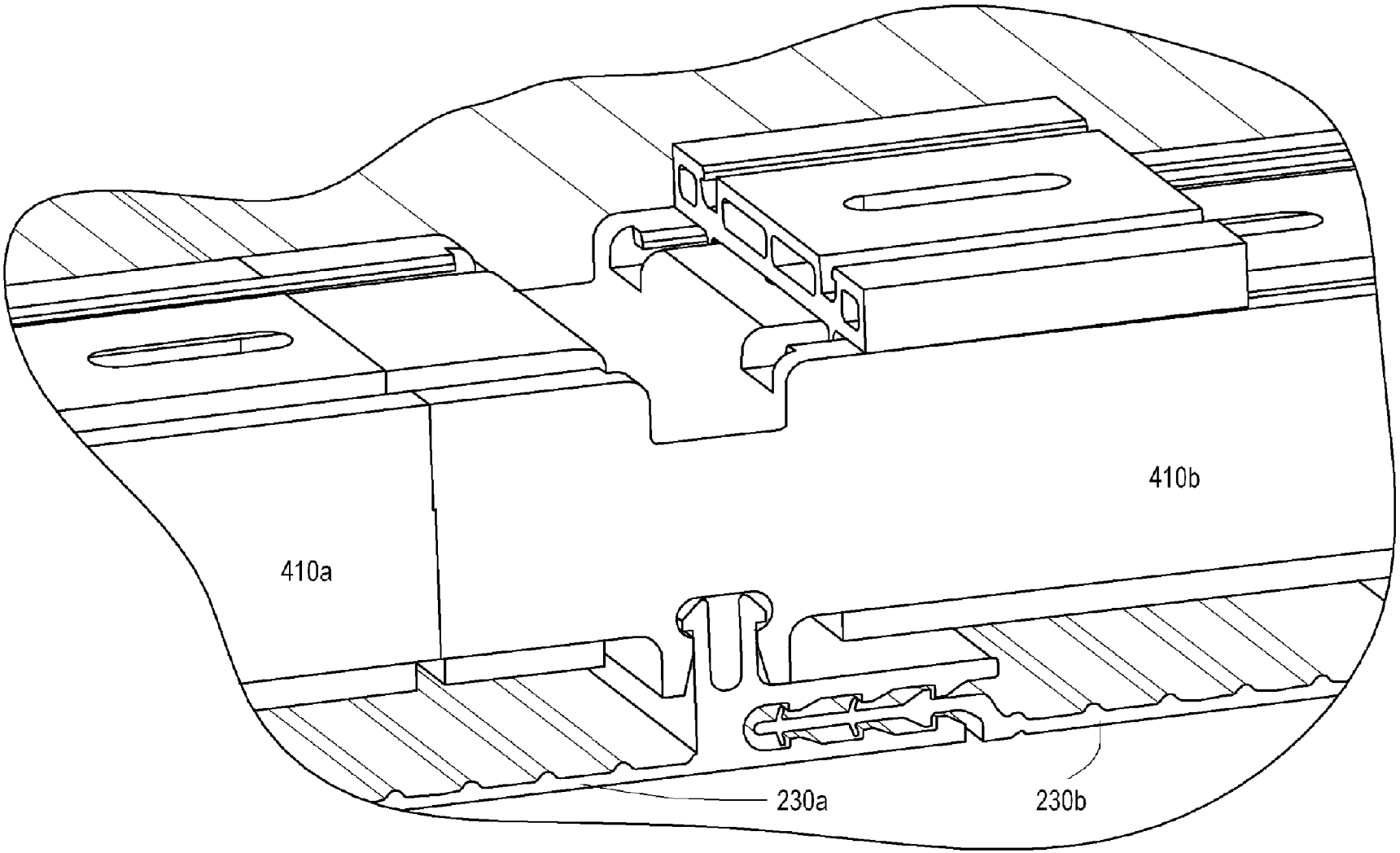
Figure 13I:
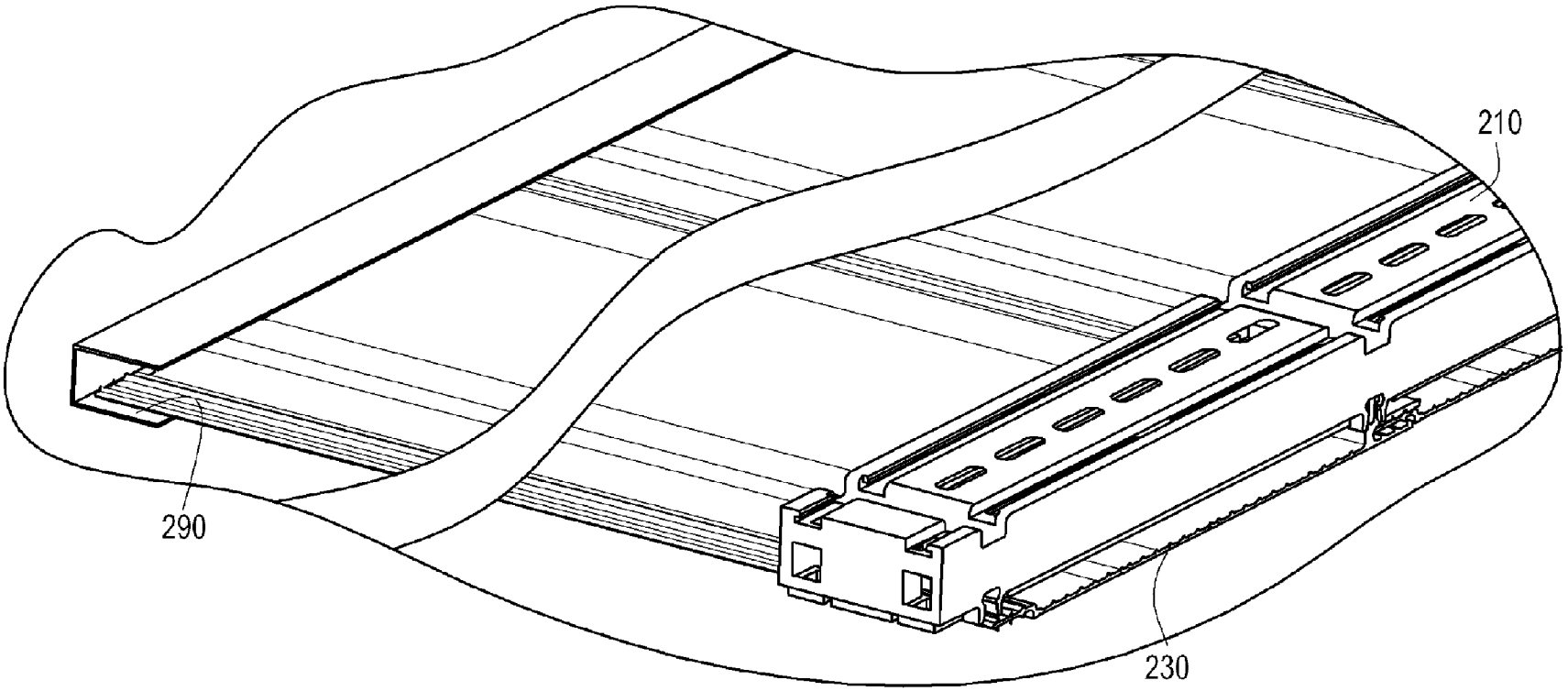
Figure 13J:
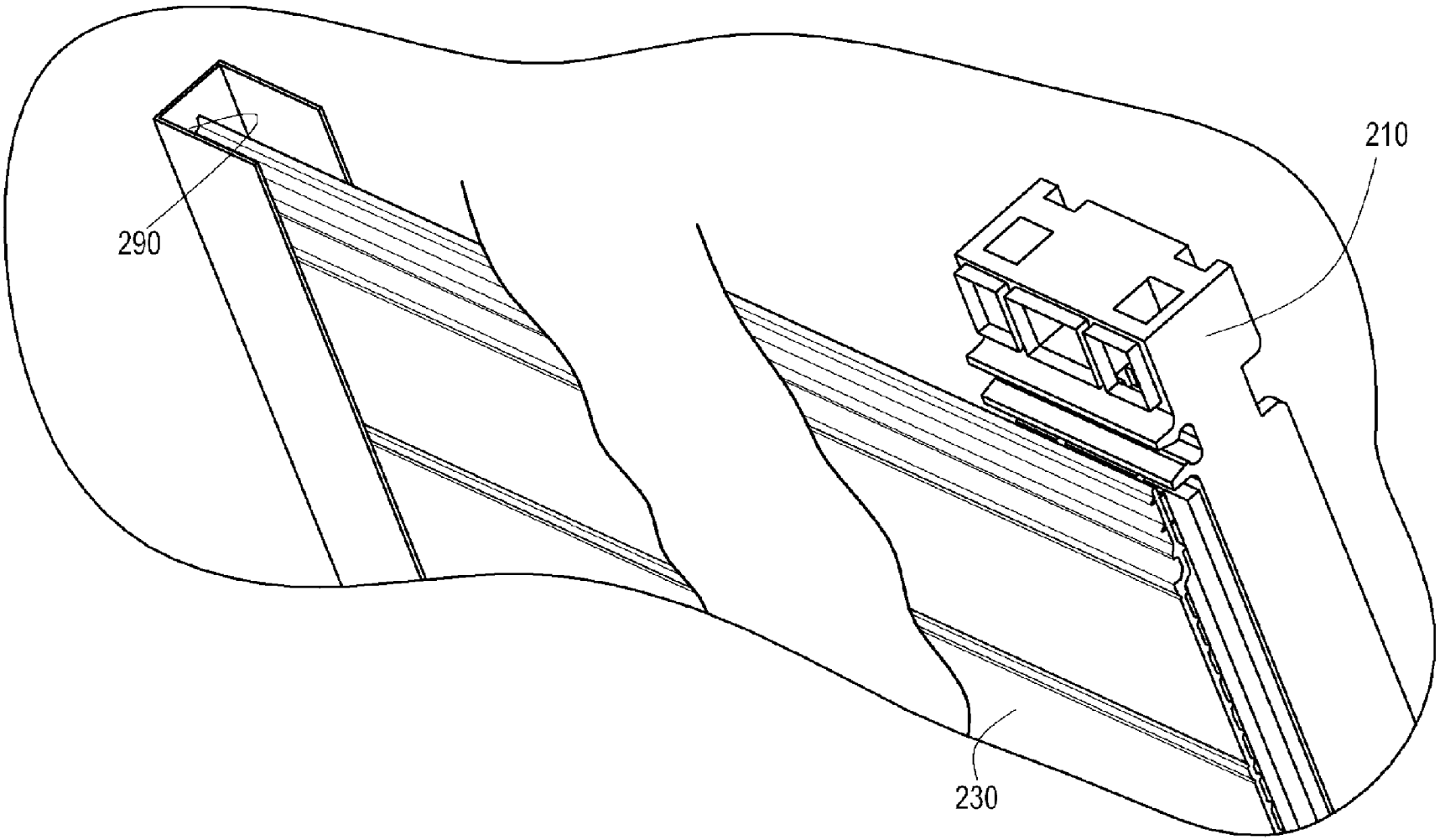

(f). Other drainage panels 230 are then installed (see FIGS. 13G and 13H). The flange 234 of next drainage panel 230*b* is inserted into the notched groove 236 of the previous installed drainage panel 230*a*, securely engaging the drainage panel 230*b* into the notched groove 236 of the drainage panel 230*a*. The U-shaped peg 236*c* of the drainage panel 230*b* is securely engaged in the corresponding U-shaped notched receptacle 417 of joist bracket 410*b*. FIG. 13H shows a partial perspective view of the joist bracket 210 and both installed drainage panels 230. The second drainage panel 230*b* is then installed and secured to the U-shaped notched receptacle 417 of the joist bracket 410*b* above. This step is repeated until all the drainage panels are installed and secured. FIG. 131 shows a top perspective view of the assembled underdeck drainage system. FIG. 13J shows a bottom perspective view of the assembled underdeck drainage system.

(g). Finally, a gutter system (e.g. gutter 19 in FIG. 1) is preferably installed on the lower edge of the drainage panels to collect water from the upper surface of the drainage panels and direct it to a downspout (e.g. downspout 22 in FIG. 1).

These parts such as joist brackets 110/410, drainage panels 130/230, drainage panel brackets 150 and joist bracket spacers 170/370 can be assembled in any order. Many alternative methods can also be practiced by those skilled in the art to form an underdeck drainage system.

All components of the underdeck drainage system can be made of plastic such as polyvinyl chloride (hereinafter "PVC"), polyethylene, polypropylene, acrylonnitrile-butadiene-styrene (hereinafter "ABS"), or metal such as aluminum or steel. Generally, the lumber used for constructing a deck assembly is treated with Alkaline Copper Quaternary (hereinafter "ACQ") in recent years. The ACQ treated lumber is very corrosive to aluminum or ungalvanized steel. One advantage of using plastics over metal is that underdeck drainage system made with plastic material will not experience corrosion problems caused by ACQ treated lumber. Therefore, the components with direct contact with treated lumber, such as the joist brackets or joist bracket spacers, should preferably be made of plastic such as PVC, polyethylene, polypropylene etc. The drainage panels may be made of thin aluminum sheets or preferably rectangular plastic sheets of a sufficient thickness and strength.

In order to make an underdeck drainage system more appealing, the outer surfaces of components such as panel brackets 150, and drainage panels 130 can be coextruded with various thin layers of films such as wood grain, different colors, or different patterns. In coextruding, a second extruder with different color material (the wood-grain) is used to extrude a thin layer over the top of the substrate. The components of such underdeck drainage system can be made with or without this coextruding process.

While there has been shown several and alternate embodiments of the present invention, it is to be understood that many other materials, as well as many other manufacturing techniques can be used to practice present invention, and certain changes can be made in the form and arrangement of the elements of the devices as would be known to one skilled in the art without departing from the underlying scope of the invention as is discussed and set forth above. Furthermore, the embodiments described above are only intended to illustrate the principles of the present invention and are not intended to limit the scope of the invention to the disclosed elements.

The underdeck drainage system of the present invention can find many applications in a wide spectrum of fields. Among them, one of the application as a Deck/Home/Mobile Home skirt system is given as an example.

Figure 14:
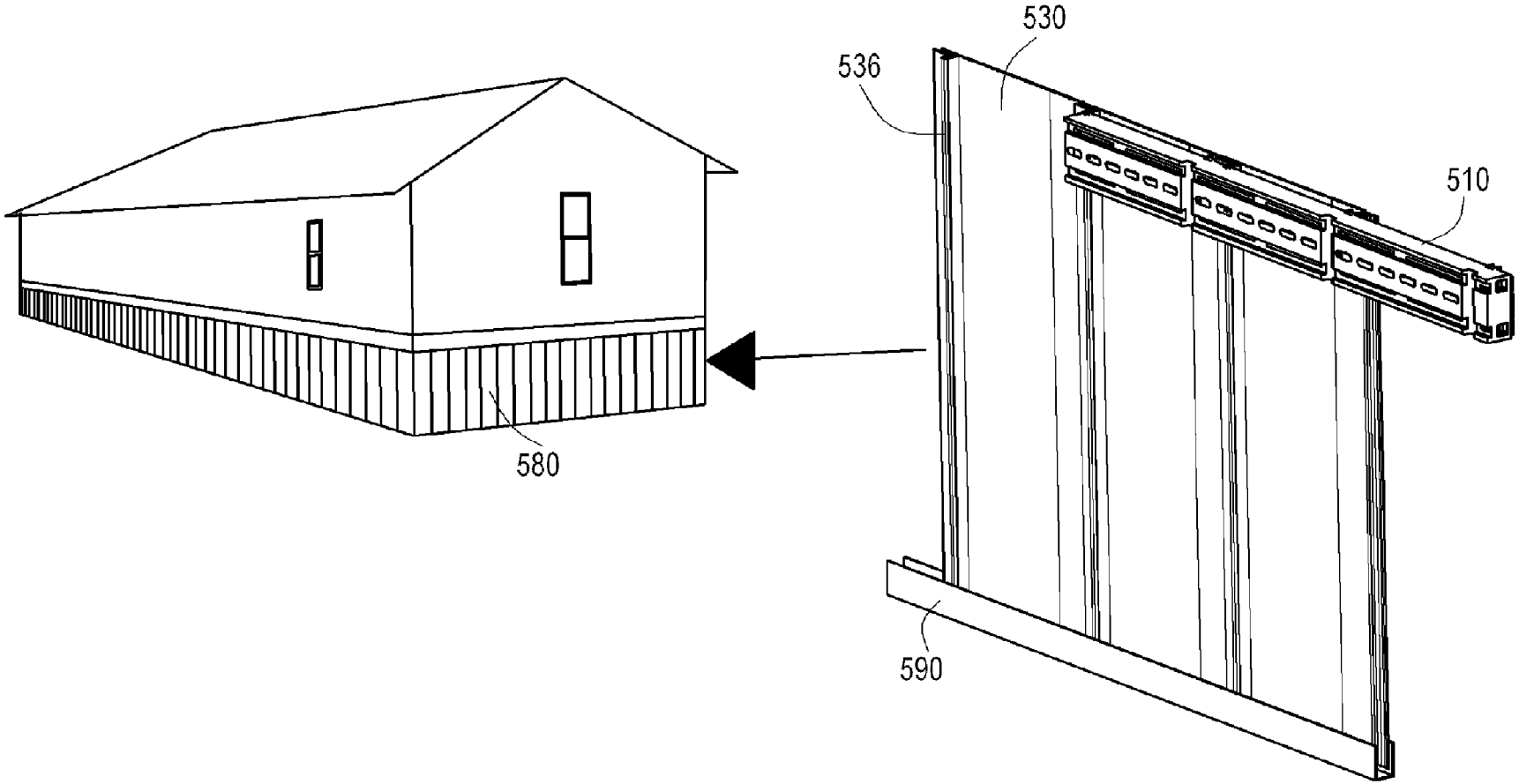
FIG. 14 shows an application of a panel system constructed in accordance with aspects of the inventions utilized as a skirting system.
Figure 15:
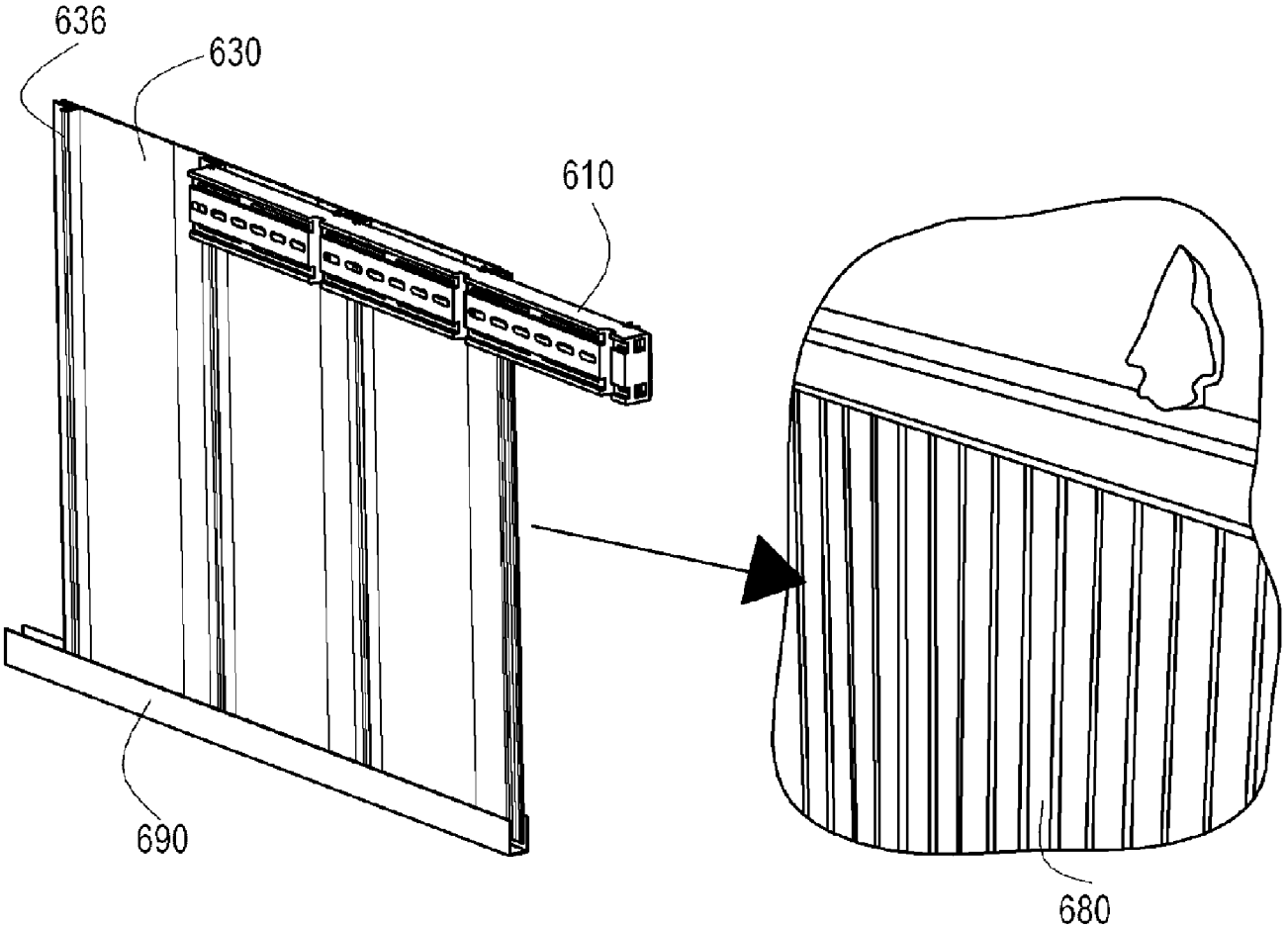
FIG. 15 shows an alternative application of a panel system used as a skirting system according to one embodiment of the present invention.

FIG. 14 illustrates an alternative use of a panel assembly using components as described herein, to construct a skirting system for a preconstructed or prefabricated (e.g. mobile) home. A skirting system comprises a plurality of support brackets, a plurality of protective panels 530, and a plurality of panel brackets 536 and a plurality of U-shaped channels 590. The skirting system can be constructed for a deck, a home, or a mobile home to protect the deck, the home or the mobile home from water damage, to prevent small animals from getting into the area under the decks, homes or mobile homes. In this case, the support brackets 510 are attached to the lower part of the deck/home/mobile home. Since this product is used mainly for aesthetic purpose and installed vertically, the panels 530 do not carry water. Therefore one set of support brackets 510 on the top part of the mobile home skirt is often strong enough to hold the panels 530 in place with the help of the U-shaped channels 590 at the bottom. The asymmetric panels with partial panel bracket 630 can also be used to form skirts of a deck, a home or a mobile home as shown in FIG. 15. The use of the panels 530 or 630 provides the skirts a uniform, clean and neat look.

Other applications include sun shades, sunroom roof, portions of screened porches, portions of car ports, wall decoration, or other places of interest.

The foregoing description of the exemplary embodiments of the present invention has been presented only for the purposes of illustration and description and is not intended to be exhaustive or to limit the invention to the precise forms disclosed. Many modifications and variations are possible in the light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments and will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A drainage system for draining water beneath a deck assembly supported by a plurality of generally parallel, spaced-apart joists, each joist including a downwardly-facing bottom surface, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, each joist bracket further including a top surface, the top surface mounted to the downwardly-facing bottom surface of at least one joist, each joist bracket also including at least one panel bracket holding member;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket; and (c). at least one drainage panel for disposition generally horizontally underneath one or more joist brackets and for carrying water to an edge for drainage, the drainage panel including oppositely disposed support flanges extending along opposite lateral edges of the panel and operative for engaging with the U-shaped receptacles of a panel bracket.

2. The drainage system of claim 1, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

3. The drainage system of claim 1, wherein the mounting element of the panel bracket comprises a U-shaped peg lengthwise protruding from the panel bracket, for slidably and/or snap engaging with the panel bracket holding member of a joist bracket.

4. The drainage system of claim 3, wherein a first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacle of the plurality of joist brackets, respectively, such that the plurality of drainage panels are engaged with the plurality of panel brackets, which, in turn, are engaged with the plurality of joist brackets.

5. The drainage system of claim 1, further comprising a plurality of stackable joist bracket spacers mountable to the plurality of joist brackets for setting up a pitch of the drainage system.

6. The drainage system of claim 5, wherein each of the plurality of joist bracket spacers comprises a frame, a ring forming an opening, and a plurality of ribs connecting the ring and the frame.

7. The drainage system of claim 6, wherein each of the plurality of joist bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer; respectively.

8. The drainage system of claim 7, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

9. The drainage system of claim 5, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

10. The drainage system of claim 5, wherein each joist bracket spacer includes an opening for allowing a fastener to pass therethrough and also includes one or more notched pegs on one surface and one or more grooves on another surface, and wherein when stacked the pegs of one joist bracket spacers are received in and engaged with the grooves of an adjoining joist bracket spacer such that one surface of a joist bracket spacer is in contact with a joist bracket, another surface is in contact with a second joist bracket spacer, and the opening of the joist bracket spacers are substantially aligned with the mounting opening of a joist bracket.

11. The drainage system of claim 1, wherein each of the plurality of joist brackets further comprises a connector element at one end and a corresponding mating connector element at the opposite end, for connecting and holding together multiple joist brackets for additional length.

12. The drainage system of claim 11, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

13. The drainage system of claim 11, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

14. The drainage system of claim 1, wherein each of the plurality of drainage panels comprises a first surface, an opposite second surface, and a plurality of ridges lengthwise protruding from the first surface to form a plurality of drainage channels thereon.

15. The drainage system of claim 1, wherein each of flanges of a drainage panel includes one or more protrusions lengthwise formed on flange surfaces for engaging with corresponding U-shaped grooves in a panel bracket.

16. The drainage system of claim 1, wherein each of the plurality of joist brackets, drainage panels, and panel brackets is made of plastic, metal, or other rigid material.

17. A drainage system for mounting beneath a deck assembly, the deck assembly having spaced floor boards extending over a predetermined surface area, the spaced floor boards being supported by a plurality of parallel, regularly-spaced joists, comprising:

(a). a plurality of joist brackets mountable to the plurality of joists, each having a bottom portion, an opposite top portion, at least one notched receptacle widthwise protruding from the bottom portion at a predetermined position, a pair of notched grooves lengthwise formed on the top portion, and a plurality of obround openings regularly formed on the top portion;

(b). a plurality of drainage panels, each having a first edge and an opposite second edge, a first flange and an opposite second flange extending outward and widthwise from the first edge and the second edge, respectively; and (c). a plurality of panel brackets, each having a first surface, an opposite second surface, a U-shaped peg lengthwise protruding from the first surface, a first U-shaped notched receptacle and an opposite second U-shaped notched receptacle defined between the first surface and the second surface, wherein, in operation, a first flange and a second flange of each of the plurality of drainage panels are received in a first U-shaped notched receptacle of one of the plurality of panel brackets and a second U-shaped notched receptacle of another one of the plurality of the panel brackets, respectively, and U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

18. The drainage system of claim 17, further comprising a plurality of joist bracket spacers mountable to the plurality of joist brackets for setting up a pitch of the drainage system.

19. The drainage system of claim 18, wherein each of the plurality of joist bracket spacers comprises a frame, a ring forming an opening, and a plurality of ribs connecting the ring and the frame.

20. The drainage system of claim 19, wherein each of the plurality of joist bracket spacers further comprises a first end portion, an opposite, second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

21. The drainage system of claim 20, wherein, in operation, the first pair of pegs and the second pair of pegs of one of the plurality of joist bracket spacers are received in and engaged with the pair of notched grooves of one of the plurality of joist brackets, respectively.

22. The drainage system of claim 18, wherein each of the plurality of joist bracket spacers comprises a first surface, an opposite, second surface, a opening formed through the first, surface and the second surface at a predetermined position, a pair of notched grooves formed on the first surface, and a pair of notched pegs formed on the second surface at corresponding positions of the pair of notched grooves such that when two joist bracket spacers are joined, a pair of notched pegs of one of two joist bracket spacers are received in and engaged with a pair of notched grooves of the other joist bracket spacer, respectively.

23. The drainage system of claim 21, wherein, in operation, the pair of notched pegs of one of the plurality of joist bracket spacers are received in and engaged with the pair of notched grooves of one of the plurality of joist brackets such that the second surface of the corresponding joist bracket spacer is substantially in contact with the top portion of the corresponding joist bracket, and the opening of the corresponding joist bracket spacer is substantially coincident with one of the plurality of obround openings of the corresponding joist bracket.

24. The drainage system of claim 17, wherein each of the plurality of joist brackets further comprises a first end, an opposite, second end, at least one tenon formed on the first end, and at least one mortise formed on the second end such that when two joist brackets are joined, the at least one tenon of one of two joist brackets is received in and engaged with the at least one mortise of the other joist bracket.

25. The drainage system of claim 17, wherein each of the plurality of joist brackets further comprises a first end, an opposite, second end, at least one dovetailed peg formed on the first end, and at least one dovetailed notch formed on the second end such that when two joist brackets are joined, the at least one dovetailed peg of one of two joist brackets is received in and engaged with the at least one dovetailed notch of the other joist bracket.

26. The drainage system of claim 17, wherein each of the plurality of drainage panels comprises a first surface, an opposite, second surface, and a plurality of ridges lengthwise protruding from the first surface to form a plurality of drainage channels thereon.

27. The drainage system of claim 17, wherein each of the first flange and the second flange of a drainage panel has a number of protrusions lengthwise formed on flange surfaces.

28. The drainage system of claim 26, wherein each of the first U-shaped notched receptacle and the second U-shaped notched receptacle of a panel bracket ha a number of grooves lengthwise formed therein such that, in operation, the number of protrusions on the flange surfaces of the drainage panel are received in and engaged with the number of grooves, respectively.

29. The drainage system of claim 17, further comprising a trim channel cover mountable to a nondischarging end of a plurality of drainage panels.

30. The drainage system of claim 17, further comprising a gutter system mounted at a water discharging end of a plurality of drainage panels to collect water therefrom and direct it to a downspout.

31. The drainage system of claim 17, wherein each of the plurality of joist brackets, drainage panels, and panel brackets is made of plastic, metal, or other rigid material.

32. A drainage system for mounting beneath a deck assembly, the deck assembly having spaced floor boards extending over a predetermined surface area, the spaced floor boards being supported by a plurality of parallel, regularly-spaced joists, comprising:

(a). a plurality of joist brackets mountable to the plurality of joists, each having a bottom portion, an opposite top portion, at least one notched receptacle widthwise protruding from the bottom portion at a predetermined position, a pair of notched grooves lengthwise formed on the top portion, and a plurality of obround openings regularly formed through the top portion; and (b). a plurality of drainage panels, each having a first edge, an opposite second edge, a flange widthwise extending from the first edge, and a panel bracket widthwise extending from the second edge, wherein the panel bracket has a U-shaped notched receptacle parallel to the drainage panel and a U-shaped peg protruded perpendicularly and lengthwise from a junction of the second edge and the panel bracket, wherein, in operation, a flange of one of the plurality of drainage panels is received in a U-shaped notched receptacle of another one of the plurality of drainage panels, and U-shaped pegs of the plurality of drainage panels are received in corresponding notched receptacles of the plurality of joist brackets, respectively, such that the plurality of drainage panels are engaged with each other, which are engaged with the plurality of joist brackets.

33. The drainage system of claim 32, further comprising a plurality of joist bracket spacers mountable to the plurality of joist brackets for setting up a pitch of the drainage system.

34. The drainage system of claim 33, wherein each of the plurality of joist bracket spacers comprises a frame, a ring formed an opening, and a plurality of ribs connecting the ring and the frame.

35. The drainage system of claim 34, wherein each of the plurality of joist bracket spacers further comprises a first end portion, an opposite, second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

36. The drainage system of claim 35, wherein, in operation, the first pair of pegs and the second pair of pegs of one of the plurality of joist bracket spacers are received in and engaged with the pair of notched grooves of one of the plurality of joist brackets, respectively.

37. The drainage system of claim 33, wherein each of the plurality of joist bracket spacers comprises a first surface, an opposite second surface, a opening formed through the first surface and the second surface at a predetermined position, a pair of notched grooves formed on the first surface, and a pair of notched pegs formed on the second surface at corresponding positions of the pair of notched grooves such that when two joist bracket spacers are joined, a pair of notched pegs of one of two joist bracket spacers are received in and engaged with a pair of notched grooves of the other joist bracket spacer, respectively.

38. The drainage system of claim 37, wherein, in operation, the pair of notched pegs of one of the plurality of joist bracket spacers are received in and engaged with the pair of notched grooves of one of the plurality of joist brackets such that the second surface of the corresponding joist bracket spacer is substantially in contact with the top portion of the corresponding joist bracket, and the opening of the corresponding joist bracket spacer is substantially coincident with one of the plurality of obround openings of the corresponding joist bracket.

39. The drainage system of claim 32, wherein each of the plurality of joist brackets further comprises a first end, an opposite, second end, at least one tenon formed on the first end, and at least one mortise formed on the second end such that when two joist brackets are joined, the at least one tenon of one of two joist brackets is received in and engaged with the at least one mortise of the other joist bracket.

40. The drainage system of claim 32, wherein each of the plurality of joist brackets further comprises a first end, an opposite, second end, at least one dovetailed peg formed on the first end, and at least one dovetailed notch formed on the second end such that when two joist brackets are joined, the at least one dovetailed peg of one of two joist brackets is received in and engaged with the at least one dovetailed notch of the other joist bracket.

41. The drainage system of claim 32, wherein each of the plurality of drainage panels comprises a first surface, an opposite, second surface, and a plurality of ridges lengthwise protruding from the first surface to form a plurality of drainage channels thereon.

42. The drainage system of claim 32, wherein the flange of a drainage panel has a number of protrusions lengthwise formed on flange surfaces, and the U-shaped notched receptacle of the panel drainage has a number of grooves lengthwise formed therein.

43. The drainage system of claim 42, wherein when two drainage panels are connected, the number of protrusions on the flange surfaces of one of two drainage panels are received in and engaged with the number of grooves of the U-shaped notched receptacle of the other drainage panel.

44. The drainage system of claim 32, further comprising a trim channel cover mountable to a discharging end of the plurality of drainage panels to collect water therefrom and direct it to a downspout.

45. The drainage system of claim 44, wherein the trim channel cover comprises a gutter.

46. A panel system for covering an open space, the open space including a plurality of generally parallel, spaced-apart joists, each joist including a mounting surface, comprising:

at least one elongate support bracket mounted to the mounting surface of at least one joist within the open space, each support bracket including a plurality of spaced-apart mounting openings positioned along the length of the support bracket for receiving fasteners to hold the support bracket to the mounting surface of at least one joist, and also including at least one panel bracket holding member;

at least one panel bracket for affixing to a support bracket, and retaining one or two panels the panel bracket including a pair of oppositely disposed U-shaped receptacles extending generally horizontally when affixed to said support bracket, and including a mounting element for removably affixing the panel bracket to the panel bracket holding member on a support bracket; and at least one panel for disposition across one or more support brackets, the panel including oppositely disposed support flanges extending along opposite lateral edges of the panel and operative for engaging with the U-shaped receptacles of a panel bracket.

47. The panel system of claim 46, wherein the panel bracket holding member of the support bracket comprises a notched receptacle widthwise protruding from a surface of the support bracket at a predetermined position, and wherein he mounting openings comprise a plurality of obround openings formed in the body of the support bracket.

48. The panel system of claim 46, wherein the mounting element of the panel bracket comprises a U-shaped peg lengthwise protruding from the panel bracket, for slidably and/or snap engaging with the panel bracket holding member of a support bracket.

49. The panel system of claim 48, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

50. The panel system of claim 46, further comprising a plurality of stackable support bracket spacers mountable to the plurality of support brackets for holding the panels in spaced-apart relation to the support brackets.

51. The panel system of claim 50, wherein each of the plurality of support bracket spacers comprises a frame, a ring forming an opening, and a plurality of ribs connecting the ring and the frame.

52. The panel system of claim 51, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

53. The panel system of claim 52, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

54. The panel system of claim 50, wherein each of the plurality of support bracket spacers comprises a first surface, an opposite second surface, one or more grooves formed on the first surface, and one or more pegs formed on the second surface at corresponding positions of the pair of grooves, such that when two support bracket spacers are joined by stacking, a pair of notched pegs of one of two support bracket spacers are received in and engaged with a pair of grooves of the other support bracket spacer, respectively.

55. The panel system of claim 50, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

56. The panel system of claim 46, wherein each of the plurality of support brackets further comprises a connector element, at one end and a corresponding mating connector element at the opposite end, for connecting and holding together multiple joist brackets for additional length.

57. The panel system of claim 56, wherein the connector element of the support bracket comprises a tenon formed on the one end, and the mating connector element comprises a mortise formed on the opposite end, whereby when two support brackets are joined, the tenon of one of support bracket is received in and engaged with the mortise of another support bracket.

58. The panel system of claim 56, wherein the connector element of the support bracket comprises a dovetailed peg formed on the one end, and the mating connector element comprises a dovetailed notch formed on the opposite end, whereby when two support brackets are joined, the dovetailed peg of one, support bracket is received in and engaged with the dovetailed notch of another support bracket.

59. The panel system of claim 46, wherein each of flanges of a panel includes one or more protrusions lengthwise formed on flange surfaces for engaging with corresponding U-shaped grooves in a panel bracket.

60. The panel system of claim 46, wherein each of the plurality of support brackets, panels, and panel brackets is made of plastic, metal, or other rigid material.

61. A drainage system for draining water beneath a deck assembly supported by a plurality of generally parallel, spaced-apart joists, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, and also including at least one panel bracket holding member;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket; and (c). at least one drainage panel for disposition generally horizontally underneath one or more joist brackets, the drainage panel including oppositely disposed support flanges extending along opposite lateral edges of the panel and operative for engaging with the U-shaped receptacles of a panel bracket, the drainage panel further including a downwardly-depending trough running lengthwise along the drainage panel between the support flanges for channeling water to the edge of the drainage panel.

62. The drainage system of claim 61, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

63. The drainage system of claim 61, wherein the mounting element of the panel bracket comprises a U-shaped peg lengthwise protruding from the panel bracket, for slidably and/or snap engaging with the panel bracket holding member of a joist bracket.

64. The drainage system of claim 63, wherein first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

65. The drainage system of claim 61, further comprising a plurality of stackable joist bracket spacers mountable to the plurality of joist brackets for setting up a pitch of the drainage system.

66. The drainage system of claim 65, wherein each of the plurality of joist bracket spacers comprises a frame, a ring forming an opening, and a plurality of ribs connecting the ring and the frame.

67. The drainage system of claim 66, wherein each of the plurality of joist bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

68. The drainage system of claim 67, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

69. The drainage system of claim 65, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

70. The drainage system of claim 65, wherein each joist bracket spacer includes an opening for allowing a fastener to pass therethrough and also includes one or more notched pegs on one surface and one or more grooves on another surface, and wherein when stacked the pegs of one joist bracket spacers are received in and engaged with the grooves of an adjoining joist bracket spacer such that one surface of a joist bracket spacer is in contact with a joist bracket, another surface is in contact with a second joist bracket spacer, and the opening of the joist bracket spacers are substantially aligned with the mounting opening of a joist bracket.

71. The drainage system of claim 61, wherein each of the plurality of joist brackets further comprises a connector element at one end and a corresponding mating connector element at the opposite end, for connecting and holding together multiple joist brackets for additional length.

72. The drainage system of claim 71, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

73. The drainage system of claim 71, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

74. The drainage system of claim 61, wherein each of the plurality of drainage panels comprises a first surface, an opposite second surface, and a plurality of ridges lengthwise protruding from the first surface to form a plurality of drainage channels thereon.

75. The drainage system of claim 61, wherein each of flanges of a drainage panel includes one or more protrusions lengthwise formed on flange surfaces for engaging with corresponding U-shaped grooves in a panel bracket.

76. The drainage system of claim 61, wherein each of the plurality of joist brackets, drainage panels, and panel brackets is made of plastic, metal, or other rigid material.

77. A panel system for covering an open area, comprising:

at least one elongate support bracket for mounting within the open area, each support bracket including a plurality of spaced-apart mounting openings positioned along the length of the support bracket for receiving fasteners to hold the support bracket to a mounting surface, and also including at least one panel bracket holding member;

at least one panel bracket for affixing to a support bracket and retaining one or two panels, the panel bracket including a pair of oppositely disposed U-shaped receptacles extending generally horizontally when affixed to said support bracket, and including a mounting element for removably affixing the panel bracket to the panel bracket holding member on support bracket; and at least one panel for disposition across one or more support brackets, the panel including oppositely disposed support flanges extending along opposite lateral edges of the panel and operative for engaging with the U-shaped receptacles of a panel bracket, the panel further including a channel disposed between the support flanges for carrying water.

78. The panel system of claim 77, wherein the panel bracket holding member of the support bracket comprises a notched receptacle widthwise protruding from a surface of the support bracket at a predetermined position, and wherein the mounting openings comprise a plurality of obround opening formed in the body of the support bracket.

79. The panel system of claim 77, wherein the mounting element of the panel bracket comprises a U-shaped peg lengthwise protruding from the panel bracket, for slidably and/or snap engaging with the panel bracket holding member of a support bracket.

80. The panel system of claim 79, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

81. The panel system of claim 77, further comprising a plurality of stackable support bracket spacers mountable to the plurality of support brackets for holding the panels in spaced-apart relation to the support brackets.

82. The panel system of claim 81, wherein each of the plurality of support bracket spacers comprises a frame, a ring forming an opening, and a plurality of ribs connecting the ring and the frames.

83. The panel system of claim 82, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

84. The panel system of claim 83, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

85. The panel system of claim 81, wherein each of the plurality of support bracket spacers comprises a first surface, an opposite second surface, one or more grooves formed on the first surface, and one or more pegs formed on the second surface at corresponding positions of the pair of grooves, such that when two support bracket spacers are joined by stacking, a pair of notched pegs of one of two support bracket spacers are received in and engaged with a pair of grooves of the other support bracket spacer, respectively.

86. The panel system of claim 81, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

87. The panel system of claim 77, wherein each of the plurality of support brackets further comprises a connector element at one end and a corresponding mating connector element at the opposite end, for connecting and holding together multiple joist brackets for additional length.

88. The panel system of claim 87, wherein the connector element of the support bracket comprises a tenon formed on the one end, and the mating connector element comprises a mortise formed on the opposite end, whereby when two support brackets are joined, the tenon of one of support bracket is receiving and engaged with the mortise of another support bracket.

89. The panel system of claim 87, wherein the connector element of the support bracket comprises a dovetailed peg formed on the one end, and the mating connector element comprises a dovetailed notch formed on the opposite end, whereby when two support brackets are joined, the dovetailed peg of one support bracket is received in and engaged with the dovetailed notch of another support bracket.

90. The panel system of claim 77, wherein each of flanges of a panel includes one or more protrusions lengthwise formed on flange surfaces for engaging with corresponding U-shaped grooves in a panel bracket.

91. The panel system of claim 77, wherein each of the plurality of support brackets, panels, and panel brackets is made of plastic, metal, or other rigid material.

92. A drainage system for draining water beneath a deck assembly supported by a plurality of generally parallel, spaced-apart joists, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, and also including at least one panel bracket holding member;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket, wherein the mounting element of the panel bracket comprises a U-shaped peg lengthwise protruding from the panel bracket, for slidably and/or snap engaging with the panel bracket holding member of a joist bracket;

(c). at least one drainage panel for disposition generally horizontally underneath one or more joist brackets and for carrying water to an edge for drainage, the drainage panel including oppositely disposed support flanges extending along opposite lateral edges of the panel and operative for engaging with the U-shaped receptacles of a panel bracket, and wherein a first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

93. The drainage system of claim 92, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

94. The drainage system of claim 92, further comprising a plurality of stackable joist bracket spacers mountable to the plurality of joist brackets for setting up a pitch of the drainage system.

95. The drainage system of claim 94, wherein each of the plurality of joist bracket spacers comprises a frame, a ring forming an opening, and a plurality of ribs connecting the ring and the frame.

96. The drainage system of claim 95, wherein each of the plurality of joist bracket spacers further comprises a first end portion, an opposite second end portion, a first pair of openings and a first pair of pegs formed on the first end portion, and a second pair of openings, and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

97. The, drainage system of claim 96, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

98. The drainage system of claim 94, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

99. The drainage system of claim 94, wherein each joist bracket spacer includes an opening for allowing a fastener to pass therethrough and also includes one or more notched pegs on one surface and one or more grooves on another surface, and wherein when stacked the pegs of one joist bracket spacers are received in and engaged with the grooves of an adjoining joist bracket spacer such that one surface of a joist bracket spacer is in contact with a joist bracket, another surface is in contact with a second joist bracket spacer, and the opening of the joist bracket spacers at substantially aligned with the mounting opening of a joist bracket.

100. The drainage system of claim 92, wherein each of the plurality of joist brackets further comprises a connector element at one end and a corresponding mating connector element at the opposite end, for connecting and holding together multiple joist brackets for additional length.

101. The drainage system of claim 100, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

102. The drainage system of claim 100, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

103. The drainage system of claim 92, wherein each of the plurality of drainage panels comprises a first surface, an opposite second surface, and a plurality of ridges lengthwise protruding from the first surface to form a plurality of drainage channels thereon.

104. The drainage system of claim 92, wherein each of flanges of a drainage panel includes one or more protrusions lengthwise formed on flange surfaces for engaging with corresponding U-shaped grooves in a panel bracket.

105. The drainage system of claim 92, wherein each of the plurality of joist brackets, drainage panels, and panel brackets is made of plastic, metal, or other rigid material.

106. A drainage system for draining water beneath a deck assembly supported by a plurality of generally parallel, spaced-apart joists, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, and also including at least one panel bracket holding member;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket;

(c). at least one drainage panel for disposition generally horizontally underneath one or more joist brackets and for carrying water to an edge for drainage, the drainage panel including oppositely disposed support flanges extending along opposite lateral edges of the panel and operative for engaging with the U-shaped receptacles of a panel bracket; and (d). a plurality of stackable joist bracket spacers mountable to the plurality of joist brackets for setting up a pitch of the drainage system.

107. The drainage system of claim 106, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

108. The drainage system of claim 106, wherein the mounting element of the panel bracket comprises a U-shaped peg lengthwise protruding from the panel bracket, for slidably and/or snap engaging with the panel bracket holding member of a joist bracket.

109. The drainage system of claim 108, wherein a first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

110. The drainage system of claim 106, wherein each of the plurality of joist bracket spacers comprises a frame, a ring forming an opening, and a plurality of ribs connecting the ring and the frame.

111. The drainage system of claim 110, wherein each of the plurality of joist bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of to joist bracket spacers are received in and engaged with a first pair of openings and the second pair of openings of the other joist bracket spacer, respectively.

112. The drainage system of claim 111, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

113. The drainage system of claim 106, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

114. The drainage system of claim 106, wherein each joist bracket spacer includes an opening for allowing a fastener to pass therethrough and also includes one or more notched pegs on one surface and one or more grooves on another surface, and wherein when stacked the pegs of one joist bracket spacers are received in and engaged with the grooves of an adjoining joist bracket spacer such that one surface of a joist bracket spacer is in contact with a joist bracket, another surface is in contact with a second joist bracket spacer, and the opening of the joist bracket spacers are substantially aligned with the mounting opening of a joist bracket.

115. The drainage system of claim 106, wherein each of the plurality of joist brackets further comprises a connector element at one end and a corresponding mating connector element at the opposite end, for connecting and holding together multiple joist brackets for additional length.

116. The drainage system of claim 115, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

117. The drainage system of claim 115, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

118. The drainage system of claim 106, wherein each of the plurality of drainage panels comprises a first surface, an opposite second surface, and a plurality of ridges lengthwise protruding from the first surface to form a plurality of drainage channels thereon.

119. The drainage system of claim 106, wherein each of flanges of a drainage panel includes one or more protrusions lengthwise formed on flange surfaces for engaging with corresponding U-shaped grooves in a panel bracket.

120. The drainage system of claim 106, wherein each of the plurality of joist brackets, drainage panels, and panel brackets is made of plastic, metal, or other rigid material.

121. A drainage system for water beneath a deck assembly supported by a plurality of generally parallel, spaced-apart joists, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, and also including at least one panel bracket holding member, and wherein each of the plurality of joist brackets further comprises a connector element at one end and a corresponding mating connector element at the opposite end, for connecting and holding together multiple joist brackets for additional length;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket; and (c). at least one drainage panel for disposition generally horizontally underneath one or more joist brackets and for carrying water to an edge for drainage, the drainage panel including oppositely disposed support flanges extending along opposite lateral edges of the panel and operative for engaging with the U-shaped receptacles of a panel bracket.

122. The drainage system of claim 121, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

123. The drainage system of claim 121, wherein the mounting element of the panel bracket comprises a U-shaped peg lengthwise protruding from the panel bracket, for slidably and/or snap engaging with the panel bracket holding member of a joist bracket.

124. The drainage system of claim 123, wherein a first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

125. The drainage system of claim 121, further comprising a plurality of stackable joist bracket spacers mountable to the plurality of joist brackets for setting up a pitch of the drainage system.

126. The drainage system of claim 125, wherein each of the plurality of joist bracket spacers comprises a frame, a ring forming an opening, and a plurality of ribs connecting the ring and the frame.

127. The drainage system of claim 126, wherein each of the plurality of joist bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

128. The drainage system of claim 127, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

129. The drainage system of claim 125, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

130. The drainage system of claim 125, wherein each joist bracket spacer includes an opening for allowing a fastener to pass therethrough and also includes one or more notched pegs on one surface and one or more grooves on another surface, and wherein when stacked the pegs of one joist bracket spacers are received in an engaged with the grooves of an adjoining joist bracket spacer such that one surface of a joist bracket spacer is in contact with a joist bracket, another surface is in contact with a second joist bracket spacer, and the opening of the joist bracket spacers are substantially aligned with the mounting opening of a joist bracket.

131. The drainage system of claim 121, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

132. The drainage system of claim 121, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

133. The drainage system of claim 121, wherein each of the plurality of drainage panels comprises a first surface, an opposite second surface, and a plurality of ridges lengthwise protruding from the first surface to form a plurality of drainage channels thereon.

134. The drainage, system of claim 121, wherein each of flanges of a drainage panel includes one or more protrusions lengthwise formed on flange surfaces for engaging with corresponding U-shaped grooves in a panel bracket.

135. The drainage system of claim 121, wherein each of the plurality of joist brackets, drainage panels, and panel brackets is made of plastic, metal, or other rigid material.

136. A drainage system for draining water beneath a deck assembly supported by a plurality of generally parallel, spaced-apart joists, comprising:

(a). at least one elongate joist bracket for mounting transversely underneath a plurality of joists, each joist bracket including a plurality of spaced-apart mounting openings positioned along the length of the bracket for receiving fasteners to hold the joist bracket to the joists, and also including at least one panel bracket holding member;

(b). at least one panel bracket for affixing to a joist bracket and retaining one or two drainage panels, the panel bracket including a pair of oppositely disposed U-shaped receptacles extending generally horizontally when affixed to said joist bracket, and including a mounting element for removably affixing the panel bracket to the panel bracket holding member on a joist bracket; and (c). at least one drainage panel for disposition generally horizontally underneath one or more joist brackets and for carrying water to an edge for drainage, the drainage panel including oppositely disposed support flanges extending along opposite lateral edges of the panel and operative for engaging with the U-shaped receptacles of a panel bracket, wherein each of flanges of a drainage panel includes one or more protrusions lengthwise formed on flange surfaces for engaging with corresponding U-shaped grooves in a panel bracket.

137. The drainage system of claim 136, wherein the panel bracket holding member of the joist bracket comprises a notched receptacle widthwise protruding from a surface of the joist bracket at a predetermined position, and wherein the mounting openings comprise a plurality of obround openings formed in the body of the joist bracket.

138. The drainage system of claim 136, wherein the mounting element of the panel bracket comprises a U-shaped peg lengthwise protruding from the panel bracket, for slidably and/or snap engaging with the panel bracket holding member of a joist bracket.

139. The drainage system of claim 138, wherein a first flange and a second flange of each of a plurality of drainage panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of joist brackets, respectively, such that the plurality of drainage panels are engaged with the plurality of panel brackets, which, in turn, are engaged with the plurality of joist brackets.

140. The drainage system of claim 136, further comprising a plurality of stackable joist bracket spacers mountable to the plurality of joist brackets for setting up a pitch of the drainage system.

141. The drainage system of claim 140, wherein each of the plurality of joist bracket spacers comprises a frame, a ring forming an opening, and a plurality of ribs connecting the ring and the frame.

142. The drainage system of claim 141, wherein each of the plurality of joist bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two joist bracket spacers are joined, the first pair of pegs and the second pair of pegs of one of two joist bracket spacers are received in and engaged with a first pair of openings and the second pair of openings of the other joist bracket spacer, respectively.

143. The drainage system of claim 142, further comprising a pair of parallel grooves formed in the joist brackets for receiving the joist bracket spacers, and wherein the first pair of pegs and the second pair of pegs of one of the plurality of joist bracket spacers are received in and engaged with the pair of grooves of one of the plurality of joist brackets, respectively.

144. The drainage system of claim 140, wherein each of the plurality of joist bracket spacers comprises a first surface, an opposite second surface, one or more grooves formed on the first surface, and one or more pegs formed on the second surface at corresponding positions of the pair of grooves, such that when two joist bracket spacers are joined by stacking, a pair of notched pegs of one of two joist bracket spacers are received in and engaged with a pair of grooves of the other joist bracket spacer, respectively.

145. The drainage system of claim 140, wherein each joist bracket spacer includes an opening for allowing a fastener to pass therethrough and also includes one or more notched pegs on one surface and one or more grooves on another surface, and wherein when stacked the pegs of one joist bracket spacers are received in and engaged with the grooves of an adjoining joist bracket spacer such that one surface of a joist bracket spacer is in contact with a joist bracket, another surface is in contact with a second joist bracket spacer, and the opening of the joist bracket spacers are substantially aligned with the mounting opening of a joist bracket.

146. The drainage system of claim 136, wherein each of the plurality of joist brackets further comprises a connector element at one end and a corresponding mating connector element at the opposite end, for connecting and holding together multiple joist brackets for additional length.

147. The drainage system of claim 146, wherein the connector element of the joist bracket comprises a tenon formed on the one end, and the mating connector element comprises a mortise formed on the opposite end, whereby when two joist brackets are joined, the tenon of one of joist bracket is received in and engaged with the mortise of another joist bracket.

148. The drainage system of claim 146, wherein the connector element of the joist bracket comprises a dovetailed peg formed on the one end, and the mating connector element comprises a dovetailed notch formed on the opposite end, whereby when two joist brackets are joined, the dovetailed peg of one of joist bracket is received in and engaged with the dovetailed notch of another joist bracket.

149. The drainage system of claim 136, wherein each of the plurality of drainage panels comprises a first surface, an opposite second surface, and a plurality of ridges lengthwise protruding from the first surface to form a plurality of drainage channels thereon.

150. The drainage system of claim 136, wherein each of the plurality of joist brackets, drainage panels, and panel brackets is made of plastic, metal, or other rigid material.

151. A panel system for covering an open area, comprising:

at least one elongate support bracket for mounting within the open space, each support bracket including a plurality of spaced-apart mounting openings positioned along the length of the support bracket for receiving fasteners to hold the support bracket to a mounting surface, and also including at least one panel bracket holding member;

at least one panel bracket for affixing to a support bracket and retaining one or two panels, the panel bracket including a pair of oppositely disposed U-shaped receptacles extending generally horizontally when affixed to said support bracket, and including a mounting element for removably affixing the panel bracket to the panel bracket holding member on a support bracket, wherein the mounting element of the panel bracket comprises a U-shaped peg lengthwise protruding from the panel bracket, for slidably and/or snap engaging with the panel bracket holding member of a support bracket; and at least one panel for disposition across one or more support brackets, the panel including oppositely disposed support flanges extending along opposite lateral edges of the panel and operative for engaging with the U-shaped receptacles of a panel bracket, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

152. The panel system of claim 151, wherein the panel bracket holding member of the support bracket comprises a notched receptacle widthwise protruding from a surface of the support bracket at a predetermined position, and wherein the mounting openings comprise a plurality of obround openings formed in the body of the support bracket.

153. The panel system of claim 151, further comprising a plurality of stackable support bracket spacers mountable to the plurality of support brackets for holding the panels in spaced-apart relation to the support brackets.

154. The panel system of claim 153, wherein each of the plurality of support bracket spacers comprises a frame, a ring forming an opening, and a plurality of ribs connecting the ring and the frame.

155. The panel system of claim 154, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

156. The panel system of claim 155, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

157. The panel system of claim 153, wherein each of the plurality of support bracket spacers comprises a first surface, an opposite second surface, one or more grooves formed on the first surface, and one or more pegs formed on the second surface at corresponding positions of the pair of grooves, such that when two support bracket spaces are joined by stacking, a pair of notched pegs of one of two support bracket spacers are received in and engaged with a pair of grooves of the other support bracket spacer, respectively.

158. The panel system of claim 153, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

159. The panel system of claim 151, wherein each of the plurality of support brackets further comprises a connector element at one end and a corresponding mating connector element at the opposite end, for connecting and holding together multiple joist brackets for additional length.

160. The panel system of claim 159, wherein the connector element of the support bracket comprises a tenon formed on the one end, and the mating connector element comprises a mortise formed on the opposite end, whereby when two support brackets are joined, the tenon of one of support bracket is received in and engaged with the mortise of another support bracket.

161. The panel system of claim 159, wherein the connector element of the support bracket comprises a dovetailed peg formed on the one end, and the mating connector element comprises a dovetailed notch formed on the opposite end, whereby when two support brackets are joined, the dovetailed peg of one support bracket is received in and engaged with the dovetailed notch of another support bracket.

162. The panel system of claim 151, wherein each of flanges of a panel includes one or more protrusions lengthwise formed on flange surfaces for engaging with corresponding U-shaped grooves in a panel bracket.

163. The panel system of claim 151, wherein each of the plurality of support brackets, panels, and panel brackets is made of plastic, metal, or other rigid material.

164. A panel system for covering an open area, comprising:

at least one elongate support bracket for mounting within the open space, each support bracket including a plurality of spaced-apart mounting openings positioned along the length of the support bracket for receiving fasteners to hold the support bracket to a mounting surface, and also including at least one panel bracket holding member;

at least one panel bracket for affixing to a support bracket and retaining one or two panels, the panel bracket including a pair of oppositely disposed U-shaped receptacles extending generally horizontally when affixed to said support bracket, and including a mounting element for removably affixing the panel bracket to the panel bracket holding member on a support bracket;

at least one panel for disposition across one or more support brackets, the panel including oppositely disposed support flanges extending along opposite lateral edges of the panel and operative for engaging with the U-shaped receptacles of a panel bracket; and a plurality of stackable support bracket spacers mountable to the plurality of support brackets for holding the panels in spaced-apart relation to the support brackets.

165. The panel system of claim 164, wherein the panel bracket holding member of the support bracket comprises a notched receptacle widthwise protruding from a surface of the support bracket at a predetermined position, and wherein the mounting opening comprise a plurality of obround openings formed in the body of the support bracket.

166. The panel system of claim 164, wherein the mounting element of the panel bracket comprises a U-shaped peg lengthwise protruding from the panel bracket, for slidably and/or snap engaging with the panel bracket holding member of a support bracket.

167. The panel system of claim 166, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

168. The panel system of claim 164, wherein each of the plurality of support bracket spacers comprises a frame, a ring forming an opening, and a plurality of ribs connecting the ring and the frame.

169. The panel system of claim 168, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

170. The panel system of claim 169, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

171. The panel system of claim 164, wherein each of the plurality of support bracket spacers comprises a first surface, an opposite second surface, one or more grooves formed on the first surface, and one or more pegs formed on the second surface at corresponding positions of the pair of grooves, such that when two support bracket spacers are joined by stacking, a pair of notched pegs of one of two support bracket spacers are received in and engaged with a pair of grooves of the other support bracket spacer, respectively.

172. The panel system of claim 164, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

173. The panel system of claim 164, wherein each of the plurality of support brackets further comprises a connector element at one end and a corresponding mating connector element at the opposite end, for connecting and holding together multiple joist brackets for additional length.

174. The panel system of claim 173, wherein the connector element of the support bracket comprises a tenon formed on the one end, and the mating connector element comprises a mortise formed on the opposite end, whereby when two support brackets are joined, the tenon of one of support bracket is received in and engaged with the mortise of another support bracket.

175. The panel system of claim 173, wherein the connector element of the support bracket comprises a dovetailed peg formed on the one end, and the mating connector element comprises a dovetailed notch formed on the opposite end, whereby when two support brackets are joined, the dovetailed peg of one support bracket is received in and engaged with the dovetailed notch of another support bracket.

176. The panel system of claim 164, wherein each of flanges of a panel includes one or more protrusions lengthwise formed on flange surfaces for engaging with corresponding U-shaped grooves in a panel bracket.

177. The panel system of claim 164, wherein each of the plurality of support brackets, panels, and panel brackets is made of plastic, metal, or other rigid material.

178. A panel system for covering an open area, comprising:

at least one elongate support bracket for mounting within the open space, each support bracket including a plurality of spaced-apart mounting openings positioned along the length of the support bracket for receiving fasteners to hold the support bracket to mounting surface, and also including at least one panel bracket holding member, wherein each of the plurality of support brackets further comprises a connector element at one end and a corresponding mating connector element at the opposite end, for connecting and holding together multiple joist brackets for additional length;

at least one panel bracket for affixing to a support bracket and retaining one or two panels, the panel bracket including a pair of oppositely disposed U-shaped receptacles extending generally horizontally when affixed to said support bracket, and including a mounting element for removably affixing the panel bracket to the panel bracket holding member on a support bracket; and at least one panel for disposition across one or more support brackets, the panel including oppositely disposed support flanges extending along opposite lateral edges of the panel and operative for engaging with the U-shaped receptacles of a panel bracket.

179. The panel system of claim 178, wherein the panel bracket holding member of the support bracket comprises a notched receptacle widthwise protruding from a surface of the support bracket at a predetermined position, and wherein the mounting openings comprise a plurality of obround openings formed in the body of the support bracket.

180. The panel system of claim 178, wherein the mounting element of the panel bracket comprises a U-shaped peg lengthwise protruding from the panel bracket, for slidably and/or snap engaging with the panel bracket holding member of a support bracket.

181. The panel system of claim 180, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

182. The panel system of claim 178, further comprising a plurality of stackable support bracket spacers mountable to the plurality of support brackets for holding the panels in spaced-apart relation to the support brackets.

183. The panel system of claim 182, wherein each of the plurality of support bracket spacers comprises a frame, a ring forming an opening, and a plurality of ribs connecting the ring and the frame.

184. The panel system of claim 183, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

185. The panel system of claim 184, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

186. The panel system of claim 182, wherein each of the plurality of support bracket spacers comprises a first surface, an opposite second surface, one or more grooves formed on the first surface, and one or more pegs formed on the second surface at corresponding positions of the pair of grooves, such that when two support bracket spacers are joined by stacking, a pair of notched pegs of one of two support bracket spacers are received in and engaged with a pair of grooves of the other support bracket spacer, respectively.

187. The panel system of claim 182, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

188. The panel system of claim 178, wherein the connector element of the support bracket comprises a tenon formed on the one end, and the mating connector element comprises a mortise formed on the opposite end, whereby when two support brackets are joined, the tenon of one of support bracket is received in and engaged with the mortise of another support bracket.

189. The panel system of claim 178, wherein the connector element of the support bracket comprises a dovetailed peg formed on the one end, and the mating connector element comprises a dovetailed notch formed on the opposite end, whereby when two support brackets are joined, the dovetailed peg of one support bracket is received in and engaged with the dovetailed notch of another support bracket.

190. The panel system of claim 178, wherein each of flanges of a panel includes one or more protrusions lengthwise formed on flange surfaces for engaging with corresponding U-shaped grooves in a panel bracket.

191. The panel system of claim 178, wherein each of the plurality of support brackets, panels, and panel brackets is made of plastic, metal, or other rigid material.

192. A panel system for covering an open area, comprising:

at least one elongate support bracket for mounting within the open space, each support bracket including a plurality of spaced-apart mounting openings positioned along the length of the support bracket for receiving fasteners to hold the support bracket to a mounting surface, and also including at least one panel bracket holding member;

at least one panel bracket for affixing to a support bracket and retaining one or two panels, the panel bracket including a pair of oppositely disposed U-shaped receptacles extending generally horizontally when affixed to said support bracket, and including a mounting element for removably affixing the panel bracket to the panel bracket holding member on a support bracket; and at least one panel for disposition across one or more support brackets, the panel including oppositely disposed support flanges extending along opposite lateral edges of the panel and operative for engaging with the U-shaped receptacles of a panel bracket, wherein each of flanges of a panel includes one or more protrusions lengthwise formed on flange surfaces for engaging with corresponding U-shaped grooves in a panel bracket.

193. The panel system of claim 192, wherein the panel bracket holding member of the support bracket comprises a notched receptacle widthwise protruding from a surface of the support bracket at a predetermined position, and wherein the mounting openings comprise a plurality of obround openings formed in the body of the support bracket.

194. The panel system of claim 192, wherein the mounting element of the panel bracket comprises a U-shaped peg lengthwise protruding from the panel bracket, for slidably and/or snap engaging with the panel bracket holding member of a support bracket.

195. The panel system of claim 194, wherein a first flange and a second flange of each of a plurality of panels are received in a first U-shaped receptacle of one of a plurality of panel brackets and a second U-shaped receptacle of another one of the plurality of the panel brackets, and the U-shaped pegs of the plurality of panel brackets are received in corresponding notched receptacles of the plurality of support brackets, respectively, such that the plurality of panels are engaged with the plurality of panel brackets, which, in turn, are engaged with the plurality of support brackets.

196. The panel system of claim 192, further comprising a plurality of stackable support bracket spacers mountable to the plurality of support brackets for holding the panels in spaced-apart relation to the support brackets.

197. The panel system of claim 196, wherein each of the plurality of support bracket spacers comprises a frame, a ring forming an opening, and a plurality of ribs connecting the ring and the frame.

198. The panel system of claim 197, wherein each of the plurality of support bracket spacers further comprises a first end portion, an opposite second end portion, a first pair of openings and a first pair of pegs formed on the first end portion, and a second pair of openings and a second pair of pegs formed on the second end portion, wherein the first pair of pegs and the second pair of pegs are respectively offset from the first pair of openings and the second pair of openings such that when two support bracket spacers are joined, the first pair of pegs and the second pair of pegs of one of two support bracket spacers are received in and engaged with a first pair of openings and the second pair of openings of the other support bracket spacer, respectively.

199. The panel system of claim 198, further comprising a pair of parallel grooves formed in the support brackets for receiving the support bracket spacers, and wherein the first pair of pegs and the second pair of pegs of one of the plurality of support bracket spacers are received in and engaged with the pair of grooves of one of the plurality of support brackets, respectively.

200. The panel system of claim 196, wherein each of the plurality of support bracket spacers comprises a first surface, an opposite second surface, one or more grooves formed on the first surface, and one or more pegs formed on the second surface at corresponding positions of the pair of grooves, such that when two support bracket spacers are joined by stacking, a pair of notched pegs of one of two support bracket spacers are received in and engaged with a pair of grooves of the other support bracket spacer, respectively.

201. The panel system of claim 196, wherein each support bracket spacer includes an opening for allowing a fastener to pass therethrough and also includes one or more notched pegs on one surface and one or more grooves on another surface, and wherein when stacked the pegs of one support bracket spacers are received in and engaged with the grooves of an adjoining support bracket spacer such that one surface of a support bracket spacer is in contact with a support bracket, another surface is in contact with a second support bracket spacer, and the opening of the support bracket spacers are substantially aligned with the mounting opening of a support bracket.

202. The panel system of claim 192, wherein each of the plurality of support brackets further comprises a connector element at one end and a corresponding mating connector element at the opposite end, for connecting and holding together multiple joist brackets for additional length.

203. The panel system of claim 202, wherein the connector element of the support bracket comprises a tenon formed on the one end, and the mating connector element comprises a mortise formed on the opposite end, whereby when two support brackets are joined, the tenon of one of support bracket is received in and engaged with the mortise of another support bracket.

204. The panel system of claim 202, wherein the connector element of the support bracket comprises a dovetailed peg formed on the one end, and the mating connector element comprises a dovetailed notch formed on the opposite end, whereby when two support brackets are joined, the dovetailed peg of one support bracket is received in and engaged with the dovetailed notch of another support bracket.

205. The panel system of claim 192, wherein each of the plurality of support brackets, panels, and panel brackets is made of plastic, metal, or other rigid material.

* * * * *